US008386267B2

(12) United States Patent
Morii

(10) Patent No.: US 8,386,267 B2
(45) Date of Patent: Feb. 26, 2013

(54) STEREO SIGNAL ENCODING DEVICE, STEREO SIGNAL DECODING DEVICE AND METHODS FOR THEM

(75) Inventor: Toshiyuki Morii, Kanagawa (JP)

(73) Assignee: Panasonic Corporation, Osaka (JP)

( * ) Notice: Subject to any disclaimer, the term of this patent is extended or adjusted under 35 U.S.C. 154(b) by 318 days.

(21) Appl. No.: 12/919,100

(22) PCT Filed: Mar. 18, 2009

(86) PCT No.: PCT/JP2009/001206

§ 371 (c)(1), (2), (4) Date: Aug. 24, 2010

(87) PCT Pub. No.: WO2009/116280

PCT Pub. Date: Sep. 24, 2009

(65) Prior Publication Data

US 2011/0004466 A1 Jan. 6, 2011

(30) Foreign Application Priority Data

Mar. 19, 2008 (JP) ..... 2008-072497
Oct. 24, 2008 (JP) ..... 2008-274536

(51) Int. Cl.
*G10L 19/00* (2006.01)

(52) U.S. Cl. ..... 704/500; 704/200; 704/200.1; 704/201

(58) Field of Classification Search ..... 704/200–201, 704/500–502
See application file for complete search history.

(56) References Cited

U.S. PATENT DOCUMENTS

| | | | | |
|---|---|---|---|---|
| 7,447,317 | B2 * | 11/2008 | Herre et al. | 381/23 |
| 7,787,632 | B2 * | 8/2010 | Ojanpera | 381/23 |
| 8,170,882 | B2 * | 5/2012 | Davis | 704/500 |
| 8,194,861 | B2 * | 6/2012 | Henn et al. | 381/22 |
| 8,238,562 | B2 * | 8/2012 | Allamanche et al. | 381/23 |
| 2007/0165869 | A1 * | 7/2007 | Ojanpera | 381/23 |
| 2008/0262854 | A1 * | 10/2008 | Jung et al. | 704/500 |

(Continued)

FOREIGN PATENT DOCUMENTS

| | | |
|---|---|---|
| EP | 1876586 | 1/2008 |
| EP | 1887567 | 2/2008 |

(Continued)

OTHER PUBLICATIONS

U.S. Appl. No. 12/990,819 to Toshiyuki Morii, filed Nov. 3, 2010.

*Primary Examiner* — Douglas Godbold
(74) *Attorney, Agent, or Firm* — Greenblum & Bernstein, P.L.C.

(57) ABSTRACT

A technique of improving the degree of freedom of controlling the accuracy of encoding a stereo signal. In a stereo signal encoding device, a sum/difference calculation section generates a monophonic signal which is the sum of first and second channel signals constituting a stereo signal and a side signal which is the difference between the first channel signal and the second channel signal. A mode setting section generates mode information that indicates either a monophonic encoding mode or a stereo encoding mode. A core layer encoding section, a first extended layer encoding section, a second extended layer encoding section, and a third extended layer encoding section individually carry out the monophonic encoding using the monophonic signals or the stereo encoding using both the monophonic signal and the side signal depending on the mode information, and output to a multiplexing section the resultant encoded information from the core layer to the third extended layer.

12 Claims, 20 Drawing Sheets

U.S. PATENT DOCUMENTS

| | | | | |
|---|---|---|---|---|
| 2008/0294444 | A1* | 11/2008 | Oh et al. | 704/500 |
| 2009/0119111 | A1 | 5/2009 | Goto et al. | |
| 2009/0150162 | A1 | 6/2009 | Goto et al. | |
| 2009/0182564 | A1* | 7/2009 | Beack et al. | 704/500 |
| 2009/0262945 | A1 | 10/2009 | Teo et al. | |
| 2009/0276210 | A1 | 11/2009 | Goto et al. | |
| 2009/0299734 | A1 | 12/2009 | Zhou et al. | |
| 2010/0010811 | A1 | 1/2010 | Zhou et al. | |
| 2010/0100372 | A1 | 4/2010 | Zhou et al. | |
| 2010/0121632 | A1 | 5/2010 | Chong | |
| 2010/0121633 | A1 | 5/2010 | Chong | |
| 2010/0280822 | A1* | 11/2010 | Yoshida | 704/201 |
| 2011/0022402 | A1* | 1/2011 | Engdegard et al. | 704/501 |

FOREIGN PATENT DOCUMENTS

| | | |
|---|---|---|
| JP | 11-317672 | 11/1999 |
| JP | 2001-255892 | 9/2001 |
| JP | 2003-330497 | 11/2003 |
| JP | 2005-080063 | 3/2005 |
| WO | 2006/118179 | 11/2006 |
| WO | 2006/129615 | 12/2006 |

* cited by examiner

| | SPECTRUM CODING SECTION 326 | SPECTRUM CODING SECTION 356 |
|---|---|---|
| PULSE POSITION PER BAND | $4 \times 5$ | $5 \times 5$ |
| PULSE POLARITY PER BAND | 5 | 5 |
| POSITIONS OF PULSES SEARCHED OUT THOROUGHLY | $17 (2^{17} \geq {}_{80}C_3)$ | $14 (2^{14} \geq {}_{160}C_2)$ |
| POLARITIES OF PULSES SEARCHED OUT THOROUGHLY | 3 | 2 |
| SUM (UNIT: BIT) | 45 | 46 |

FIG.15

STEREO SIGNAL ENCODING DEVICE, STEREO SIGNAL DECODING DEVICE AND METHODS FOR THEM

TECHNICAL FIELD

The present invention relates to a stereo signal coding apparatus, stereo signal decoding apparatus, and coding and decoding methods that are used to encode stereo speech.

BACKGROUND ART

In mobile communication, compression coding for digital information about speech and images is essential for an efficient use of transmission bands. Especially, speech codec (encoding and decoding) techniques widely used in mobile phones are highly expected, and there is an increasing demand for further improved sound quality in conventional high-efficiency coding with high compression performance.

Recently, with broadbandization of communication networks, there is a demand for realization and high sound quality in speech communication, and, to meet this demand, speech communication systems using stereo speech coding techniques have been developed.

As a method of encoding stereo speech, there is a known conventional method of finding a monaural signal and side signal and encoding these signals, where the monaural signal is a sum of the left channel signal and the right channel signal and where the side signal is the difference between the left channel signal and the right channel signal (see Patent Document 1).

The left channel signal and the right channel signal represent sound heard by human's left and right ears, the monaural signal can represent the common elements between the left channel signal and the right channel signal, and the side signal can represent the spatial difference between the left channel signal and the right channel signal.

There is a high correlation between the left channel signal and the right channel signal. Consequently, compared to a case where the right channel signal and the left channel signal are encoded directly, it is possible to perform more suitable coding in accordance with the features of the monaural signal and the side signal by converting the right channel signal and the left channel signal into a monaural signal and side signal and then encoding these converted signals, so that it is possible to realize coding with less redundancy, low bit rate and high quality.

Recently, standardization of scalable codec having a multilayer configuration is studied in, for example, ITU-T (International Telecommunication Union Telecommunication Standardization Sector) and MPEG (Moving Picture Expert Group), and more efficient and higher-quality speech codec is demanded.

For example, a scalable coding apparatus based on ITU-T G.729.1 performs ITU-T recommendation G.729.1 coding of 8 kbps, and, by further encoding an enhancement layer, can perform coding of twelve kinds of bit rates such as 8 kbps, 12 kbps, 14 kbps, 16 kbps, 18 kbps, 20 kbps, 22 kbps, 24 kbps, 26 kbps, 28 kbps, 30 kbps and 32 kbps. This scalability is realized by sequentially encoding lower layer coding distortion in higher layer. That is, the G.729.1 scalable coding apparatus is formed with one core layer of a bit rate of 8 kbps, one enhancement layer of a bit rate of 4 kbps and ten enhancement layers of a bit rate of 2 kbps.

Also, as a technique of performing scalable coding of stereo signals, there is a stereo signal coding apparatus disclosed in Patent Document 2. This stereo signal coding apparatus expresses additional information for each layer by a predetermined number of bits, and, using a predetermined probability model, performs arithmetic coding of bit sequences in order from the most significant bit sequence to the least significant bit sequence. Here, this stereo signal coding apparatus has a feature of switching between the left channel signal and the right channel signal according to a predetermined rule and encoding these signals.

Patent Document 1: Japanese Patent Application Laid-open Number 2001-255892

Patent Document 2: Japanese Patent Application Laid-open Number HEI 11-317672

DISCLOSURE OF INVENTION

Problems to be Solved by the Invention

However, as described above, the stereo signal coding apparatus disclosed in Patent Document 2 is designed to switch between the left channel signal and the right channel signal according to a predetermined rule and encode these signals, that is, this coding does not depend on the correlation between the left channel signal and the right channel signal and on the significance of information. Also, there is a problem that, although it is preferable to set a layer for performing monaural coding and a layer for performing stereo coding by user operations in a stereo signal coding apparatus that performs scalable coding, the stereo signal coding apparatus disclosed in Patent Document 2 cannot support this setting.

It is therefore an object of the present invention to provide a stereo signal coding apparatus, stereo signal decoding apparatus, and coding and decoding methods for performing scalable coding based on the correlation between the left channel signal and the right channel signal and on the significance of information, and for setting a layer for performing monaural coding and a layer for performing stereo coding.

Means for Solving the Problem

The stereo signal coding apparatus of the present invention employs a configuration having: a sum and difference calculating section that generates a monaural signal related to a sum of a first channel signal and second channel signal forming a stereo signal, and generates a side signal related to a difference between the first channel signal and the second channel signal; a mode information generating section that generates mode information per layer indicating a coding mode of one of monaural coding and stereo coding; and first to N-th layer coding sections that perform monaural coding in an i-th layer (i=1, 2, . . . , N, where N is an integer equal to or greater than 2) using information related to the monaural signal or performs stereo coding in the i-th layer using both the information related to the monaural signal and information related to the side signal, based on the mode information, and provide i-th layer encoded information.

The stereo signal decoding apparatus of the present invention employs a configuration having: a receiving section that receives mode information and first to N-th layer encoded information acquired by coding processing in first to N-th layers, the mode information indicating which of monaural coding and stereo coding is performed in coding processing in an i-th layer (i=1, 2, . . . , N, where N is an integer equal to or greater than 2) of a stereo signal coding apparatus that performs coding using a first channel signal and second channel signal forming a stereo signal; first to N-th layer decoding sections that perform monaural decoding or stereo decoding using the i-th layer encoded information, based on the mode information, and provide a decoding result of a monaural signal in the i-th layer and a decoding result of a side signal in the i-th layer, the monaural signal being related to a sum of the first channel signal and the second channel signal, and the side signal being related to a difference between the first channel signal and the second channel signal; and a sum and difference calculating section that calculates a first channel decoded signal and second channel decoded signal using a decoding result of the monaural signal in the N-th layer and a decoding result of the side signal in the N-th layer.

The stereo signal coding method of the present invention includes the steps of: generating a monaural signal related to a sum of a first channel signal and second channel signal forming a stereo signal, and generating a side signal related to a difference between the first channel signal and the second channel signal; generating mode information per layer indicating a coding mode of one of monaural coding and stereo coding; and performing monaural coding in an i-th layer (i=1, 2, . . . , N, where N is an integer equal to or greater than 2) using information related to the monaural signal or performs stereo coding in the i-th layer using both the information related to the monaural signal and information related to the side signal, based on the mode information, and providing i-th layer encoded information.

The stereo signal decoding method of the present invention includes the steps of: receiving mode information and first to N-th layer encoded information acquired by coding processing in first to N-th layers, the mode information indicating which of monaural coding and stereo coding is performed in coding processing in an i-th layer (i=1, 2, . . . , N, where N is an integer equal to or greater than 2) of a stereo signal coding apparatus that performs coding using a first channel signal and second channel signal forming a stereo signal; performing monaural decoding or stereo decoding using the i-th layer encoded information, based on the mode information, and providing a decoding result of a monaural signal in the i-th layer and a decoding result of a side signal in the i-th layer, the monaural signal being related to a sum of the first channel signal and the second channel signal, and the side signal being related to a difference between the first channel signal and the second channel signal; and calculating a first channel decoded signal and a second channel decoded signal using a decoding result of the monaural signal in the N-th layer and a decoding result of the side signal in the N-th layer.

Advantageous Effect of Invention

According to the present invention, by performing scalable coding of a monaural signal ("M signal") and side signal ("S signal") calculated from the L signal and R signal of a stereo signal, and setting the coding mode for each layer in scalable coding based on mode information, it is possible to perform scalable coding according to the correlation between the left channel signal and the right channel signal and on the significance of information. Also, according to the present invention, it is possible to set a layer for performing monaural coding and a layer for performing stereo coding, so that it is possible to improve the degree of freedom in controlling the accuracy of coding.

BRIEF DESCRIPTION OF DRAWINGS

FIG. 15 illustrates bit allocation in a spectrum coding section according to Embodiment 1 of the present invention;

BEST MODE FOR CARRYING OUT THE INVENTION

Now, embodiments of the present invention will be explained in detail with reference to the accompanying drawings.

Embodiment 1

Figure 1:
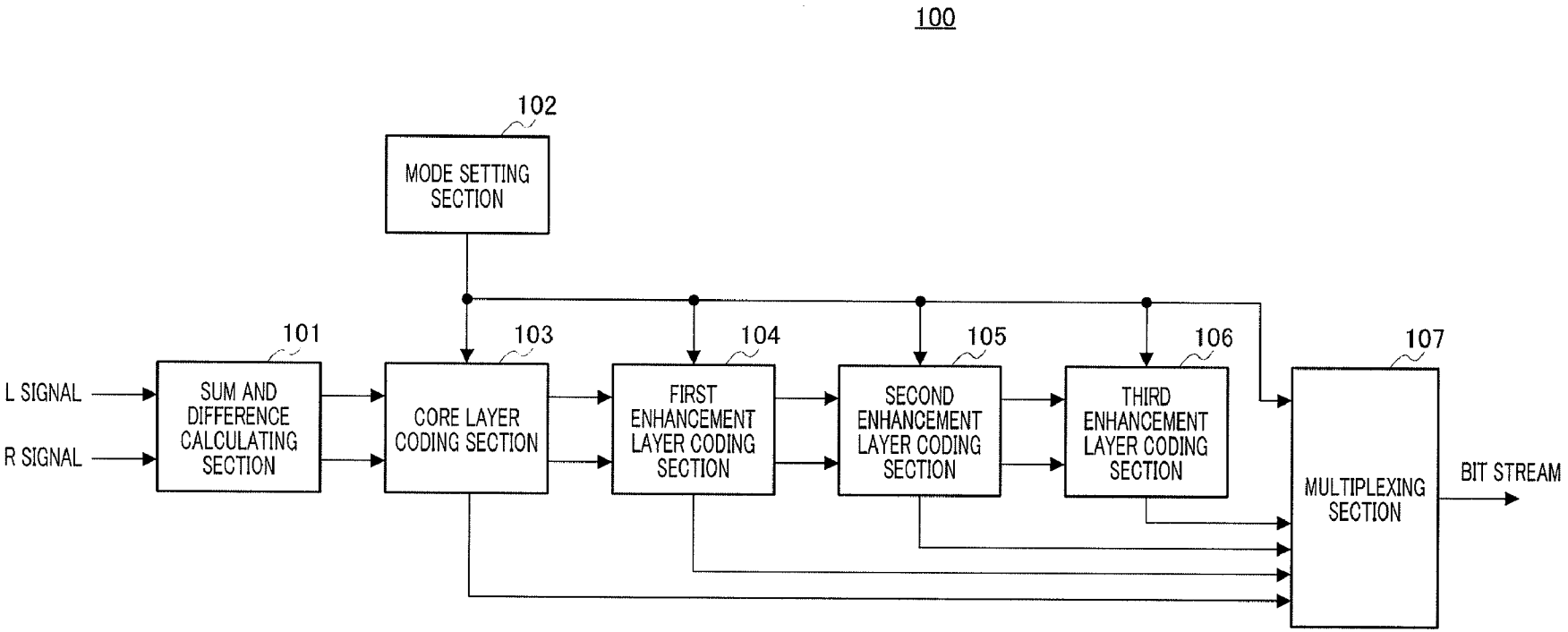
FIG. 1 is a block diagram showing the main components of a stereo signal coding apparatus according to Embodiment 1 of the present invention.

FIG. 1 is a block diagram showing the main components of stereo signal coding apparatus 100 according to Embodiment 1 of the present invention. An example case will be described where stereo signal coding apparatus 100 according to Embodiment 1 of the present invention provides one core layer and three enhancement layers. In the following, an example case will be explained where a stereo signal is comprised of a left channel signal (hereinafter "L signal") and a right channel signal (hereinafter "R signal").

In FIG. 1, stereo signal coding apparatus 100 is provided with sum and difference calculating section 101, mode setting section 102, core layer coding section 103, first enhancement layer coding section 104, second enhancement layer coding section 105, third enhancement layer coding section 106 and multiplexing section 107.

Sum and difference calculating section 101 calculates a sum signal (i.e. monaural signal, hereinafter "M signal") and a difference signal (i.e. side signal, hereinafter "S signal") using the L signal and R signal, according to following equations 1 and 2, and outputs the results to core layer coding section 103. Here, the L signal and the R signal represent sound heard by human's left and right ears, the M signal can represent the common elements between the L signal and the R signal, and the S signal can represent the spatial difference between the L signal and the R signal.

$$M_i=L_i+R_i \quad \text{(Equation 1)}$$

$$S_i=L_i-R_i \quad \text{(Equation 2)}$$

In equations 1 and 2, the subscript "i" represents the sample number of each signal, but signals may be represented without "i."

For example, the $M_i$ signal may be written simply as the M signal.

Mode information for setting the coding mode in coding sections of core layer coding section 103, first enhancement layer coding section 104, second enhancement layer coding section 105 and third enhancement layer coding section 106, is received as input in mode setting section 102 by user operations and then outputted to these coding sections and multiplexing section 107. Here, the user operations include an input from a keyboard, dip switch and button, and downloading from a PC (Personal Computer) and so on.

The coding mode in each coding section refers to monaural coding mode for encoding only M signal information, or stereo coding mode for encoding both M signal information and S signal information. Here, "M signal information" representatively refers to the M signal itself or coding distortion related to the M signal in each layer. Also, "S signal information" representatively refers to the S signal itself or coding distortion related to the S signal in each layer.

In the following, the coding mode in each layer will be shown using each of the bits of mode information. That is, in the bits, the value "0" represents the monaural coding mode and the value "1" represents the stereo coding mode. To be more specific, for example, each of the four bits of mode information is used to sequentially represent the coding modes in core layer coding section 103, first enhancement layer coding section 104, second enhancement layer coding section 105 and third enhancement layer coding section 106.

For example, four-bit-mode information "0000" means that monaural coding is performed in all layers. In this case, stereo signal coding apparatus 100 can encode the M signal with the maximum quality. Also, for example, mode information "0011" means that the coding mode in core layer coding section 103 and first enhancement layer coding section 104 is the monaural coding mode, and the coding mode in second enhancement layer coding section 105 and third enhancement layer coding section 106 is the stereo coding mode. Also, for example, mode information "1111" means that stereo coding is performed in all layers. In this case, stereo signal coding apparatus 100 can encode the M signal and S signal with equal weighting. Thus, with four-bit-mode information, it is possible to represent sixteen types of coding modes in four coding sections.

With the present embodiment, mode information outputted from mode setting section 102 is received in each coding section and multiplexing section 107 as the same input four-bit-mode information. Further, each coding section checks only one bit of the four input bits required to set the coding mode, and sets the coding mode. That is, in four bits of input mode information, core layer coding section 103 checks the first bit, first enhancement layer coding section 104 checks the second bit, second enhancement layer coding section 105 checks the third bit, and third enhancement layer coding section 106 checks the fourth bit.

However, instead of inputting the same four-bit-mode information in each coding section, mode setting section 102 may sort in advance the single bit required to set the coding mode in each coding section, and output one bit to each coding section. That is, in mode four-bit-mode information, mode setting section 102 may input only the first bit in core layer coding section 103, only the second bit in first enhancement layer coding section 104, only the third bit in second enhancement layer coding section 105, and only the fourth bit in third enhancement layer coding section 106.

Also, in any of the above cases, mode information received as input from mode setting section 102 to multiplexing section 107 refers to four-bit-mode information.

In core layer coding section 103, either the monaural coding mode or the stereo coding mode is set based on mode information received as input from mode setting section 102. Upon setting the monaural coding mode in core layer coding section 103, core layer coding section 103 encodes only the M signal received as input from sum and difference calculating section 101, and outputs the resulting monaural encoded information to multiplexing section 107 as core layer encoded information. Further, core layer coding section 103 finds and outputs the core layer coding distortion of the M signal received as input from sum and difference calculating section 101, to first enhancement layer coding section 104 as M signal information in the core layer, and outputs the S signal received as input from sum and difference calculating section 101, as is to first enhancement layer coding section 104 as S signal information in the core layer. In contrast, upon setting the stereo coding mode in core layer coding section 103, core layer coding section 103 encodes both the M signal and S signal received as input from sum and difference calculating section 101, and outputs the resulting stereo encoded information to multiplexing section 107 as core layer encoded information. Further, core layer coding section 103 finds the core layer coding distortions of the M and S signals received as input from sum and difference calculating section 101, and outputs the results to first enhancement layer coding section 104 as M signal information in the core layer and S signal information in the core layer. Also, core layer coding section 103 will be described later in detail.

In first enhancement layer coding section 104, either the monaural coding mode or the stereo coding mode is set based on mode information received as input from mode setting section 102. Upon setting the monaural coding mode in first enhancement layer coding section 104, first enhancement layer coding section 104 encodes the M signal information in the core layer received as input from core layer coding section 103, and outputs the resulting monaural encoded information to multiplexing section 107 as first enhancement layer encoded information. Further, using the M signal information in the core layer received as input from core layer coding section 103, first enhancement layer coding section 104 finds and outputs the first enhancement layer coding distortion related to the M signal to second enhancement layer coding section 105 as M signal information in the first enhancement layer, and outputs the S signal information in the core layer received as input from core layer coding section 103, as is to second enhancement layer coding section 105 as S signal information in the first enhancement layer.

By contrast, upon setting the stereo coding mode in first enhancement layer coding section 104, first enhancement layer coding section 104 encodes both the M signal information in the core layer and S signal information in the core layer received as input from core layer coding section 103, and outputs the resulting stereo encoded information to multiplexing section 107 as first enhancement layer encoded information. Further, using the M signal information in the core layer and S signal information in the core layer received as input from core layer coding section 103, first enhancement layer coding section 104 finds and outputs the first enhancement layer coding distortions related to the M and S signals to second enhancement layer coding section 105, as M signal information in the first enhancement layer and S signal information in the first enhancement layer. Also, first enhancement layer coding section 104 will be described later in detail.

In second enhancement layer coding section 105, either the monaural coding mode or the stereo coding mode is set based on mode information received as input from mode setting section 102. Upon setting the monaural coding mode in second enhancement layer coding section 105, second enhancement layer coding section 105 encodes the M signal information in the first enhancement layer received as input from first enhancement layer coding section 104, and outputs the resulting monaural encoded information to multiplexing section 107 as second enhancement layer encoded information. Further, using the M signal information in the first enhancement layer received as input from first enhancement layer coding section 104, second enhancement layer coding section 105 finds and outputs the second enhancement layer coding distortion related to the M signal to third enhancement layer coding section 106 as M signal information in the second enhancement layer, and outputs the S signal information in the first enhancement layer received as input from first enhancement layer coding section 104, as is to third enhancement layer coding section 106 as S signal information in the second enhancement layer.

By contrast, upon setting the stereo coding mode in second enhancement layer coding section 105, second enhancement layer coding section 105 encodes both the M signal information in the first enhancement layer and S signal information in the first enhancement layer received as input from first enhancement layer coding section 104, and outputs the resulting stereo encoded information to multiplexing section 107 as second enhancement layer encoded information. Further, using the M signal information in the first enhancement layer and S signal information in the first enhancement layer received as input from first enhancement layer coding section 104, second enhancement layer coding section 105 finds and outputs the second enhancement layer coding distortions related to the M and S signals to third enhancement layer coding section 106, as M signal information in the second enhancement layer and S signal information in the second enhancement layer. Also, second enhancement layer coding section 105 will be described later in detail.

In third enhancement layer coding section 106, either the monaural coding mode or the stereo coding mode is set based on mode information received as input from mode setting section 102. Upon setting the monaural coding mode in third enhancement layer coding section 106, third enhancement layer coding section 106 encodes the M signal information in the second enhancement layer received as input from second enhancement layer coding section 105, and outputs the resulting monaural encoded information to multiplexing section 107 as third enhancement layer encoded information.

By contrast, upon setting the stereo coding mode in third enhancement layer coding section 106, third enhancement layer coding section 106 encodes both the M signal information in the second enhancement layer and S signal information in the second enhancement layer received as input from second enhancement layer coding section 105, and outputs the resulting stereo encoded information to multiplexing section 107 as third enhancement layer encoded information. Also, third enhancement layer coding section 106 will be described later in detail.

Multiplexing section 107 multiplexes mode information received as input from mode setting section 102, core layer encoded information received as input from core layer coding section 103, first enhancement layer encoded information received as input from first enhancement layer coding section 104, second enhancement layer encoded information received as input from second enhancement layer coding section 105 and third enhancement layer encoded information received as input from third enhancement layer coding section 106, and generates bit streams to be transmitted to the stereo signal decoding apparatus.

In stereo signal coding apparatus 100, core layer coding section 103, first enhancement layer coding section 104 and second enhancement layer coding section 105 have the same configuration and therefore perform basically the same operations, but are different from each other only in their input signals and output signals. Third enhancement layer coding section 106 does not require a configuration for finding coding distortion, and therefore differs from the above three coding sections in part of the configuration. That is, third enhancement layer coding section 106 employs a configuration removing monaural decoding section 303, stereo decoding section 306, switch 307, adder 308, adder 309 and switch 310 from the configuration shown in FIG. 2. As for the above three coding sections having the same configuration, for example, core layer coding section 103: receives as input the M signal and the S signal; upon performing monaural coding, outputs to first enhancement layer coding section 104 the core layer coding distortion of the M signal as M signal information and the S signal itself as S signal information; and, upon performing stereo coding, outputs to first enhancement layer coding section 104 the core layer coding distortion of the M signal as M signal information and the core layer coding distortion of the S signal as S signal information.

Also, first enhancement layer coding section 104 and second enhancement layer coding section 105: receive as input M signal information in the previous layer and S signal information in the pervious layer; upon performing monaural coding, output to an coding section in a subsequent layer the coding distortion acquired by further encoding M signal information in the previous layer and S signal information itself in the previous layer; and, upon performing stereo coding, output to an coding section in a subsequent layer the coding distortion acquired by further encoding M signal information in the previous layer and the coding distortion acquired by further encoding S signal information in the previous layer. In the following, the configurations and operations of the above coding sections will be explained, using core layer coding section 103 as an example.

Figure 2:
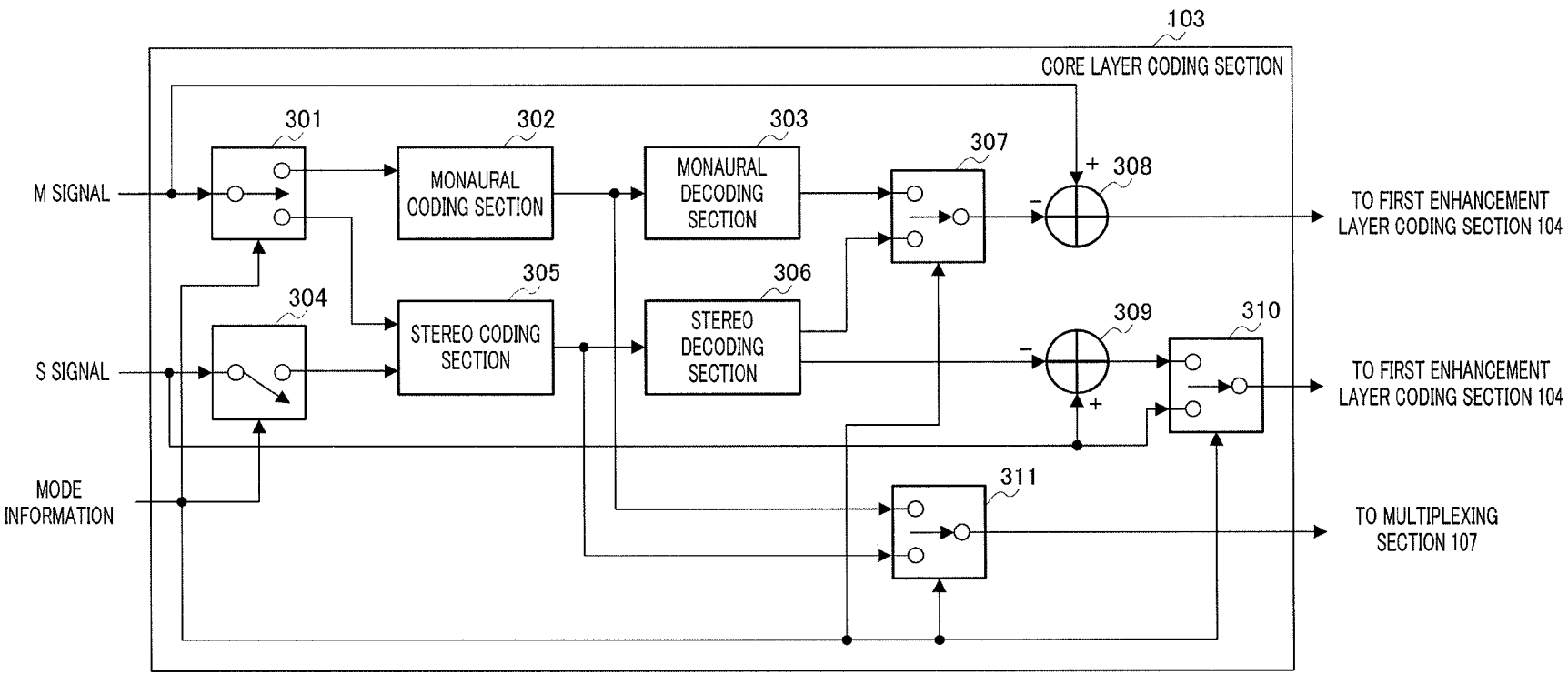
FIG. 2 is a block diagram showing the main components inside a core layer coding section according to Embodiment 1 of the present invention.

FIG. 2 is a block diagram showing the main components inside core layer coding section 103.

In FIG. 2, core layer coding section 103 is provided with switch 301, monaural coding section 302, monaural decoding section 303, switch 304, stereo coding section 305, stereo decoding section 306, switch 307, adder 308, adder 309, switch 310 and switch 311.

If the first bit value of mode information received as input from mode setting section 102 is "0," switch 301 outputs the M signal received as input from sum and difference calculating section 101, to monaural coding section 302, and, if the first bit value of mode information received as input from mode setting section 102 is "1," outputs the M signal received as input from sum and difference calculating section 101, to stereo coding section 305.

Monaural coding section 302 performs coding (i.e. monaural coding) using the M signal received as input from switch 301, and outputs the resulting monaural encoded information to monaural decoding section 303 and switch 311. Also, monaural coding section 302 will be described later in detail.

Monaural decoding section 303 decodes the monaural encoded information received as input from monaural coding section 302, and outputs the resulting decoded signal (i.e. monaural decoded M signal) to switch 307. Also, monaural decoding section 303 will be described later in detail.

If the first bit value of mode information received as input from mode setting section 102 is "1," switch 304 outputs the S signal received as input from sum and difference calculating section 101, to stereo coding section 305.

Stereo coding section 305 performs coding (i.e. stereo coding) using the M signal received as input from switch 301 and the S signal received as input from switch 304, and outputs the resulting stereo encoded information to stereo decoding section 306 and switch 311. Also, stereo coding section 305 will be described later in detail.

Stereo decoding section 306 decodes the stereo encoded information received as input from stereo coding section 305 and outputs the two resulting decoded signals, that is, the stereo decoded M signal and the stereo decoded S signal, to switch 307 and adder 309, respectively.

If the first bit value of mode information received as input from mode setting section 102 is "0," switch 307 outputs the monaural decoded M signal received as input from monaural decoding section 303, to adder 308, or, if the first bit value of mode information received as input from mode setting section 102 is "1," outputs the stereo decoded M signal received as input from stereo decoding section 306, to adder 308.

Adder 308 calculates the difference between the M signal received as input from sum and difference calculating section 101 and one of the monaural decoded M signal and stereo decoded M signal received as input from switch 307, as the core layer coding distortion of the M signal. Further, adder 308 outputs this core layer coding distortion of the M signal to first enhancement layer coding section 104, as M signal information in the core layer.

Adder 309 calculates the difference between the S signal received as input from sum and difference calculating section 101 and the stereo decoded S signal received as input from stereo decoding section 306, as the core layer coding distortion of the S signal. Further, adder 309 outputs this core layer coding distortion of the S signal to switch 310.

If the first bit value of mode information received as input from mode setting section 102 is "0," switch 310 outputs the S signal received as input from sum and difference calculating section 101, as is to first enhancement layer coding section 104 as S signal information in the core layer. If the first bit value of mode information received as input from mode setting section 102 is "1," switch 310 outputs the core layer coding distortion of the S signal received as input from adder 309, to first enhancement layer coding section 104 as S signal information in the core layer.

If the first bit value of mode information received as input from mode setting section 102 is "0," switch 311 outputs the monaural encoded information received as input from monaural coding section 302, to multiplexing section 107 as core layer encoded information. If the first bit value of mode information received as input from mode setting section 102 is "1," switch 311 outputs the stereo encoded information received as input from stereo coding section 305, to multiplexing section 107 as core layer encoded information.

Figure 3:
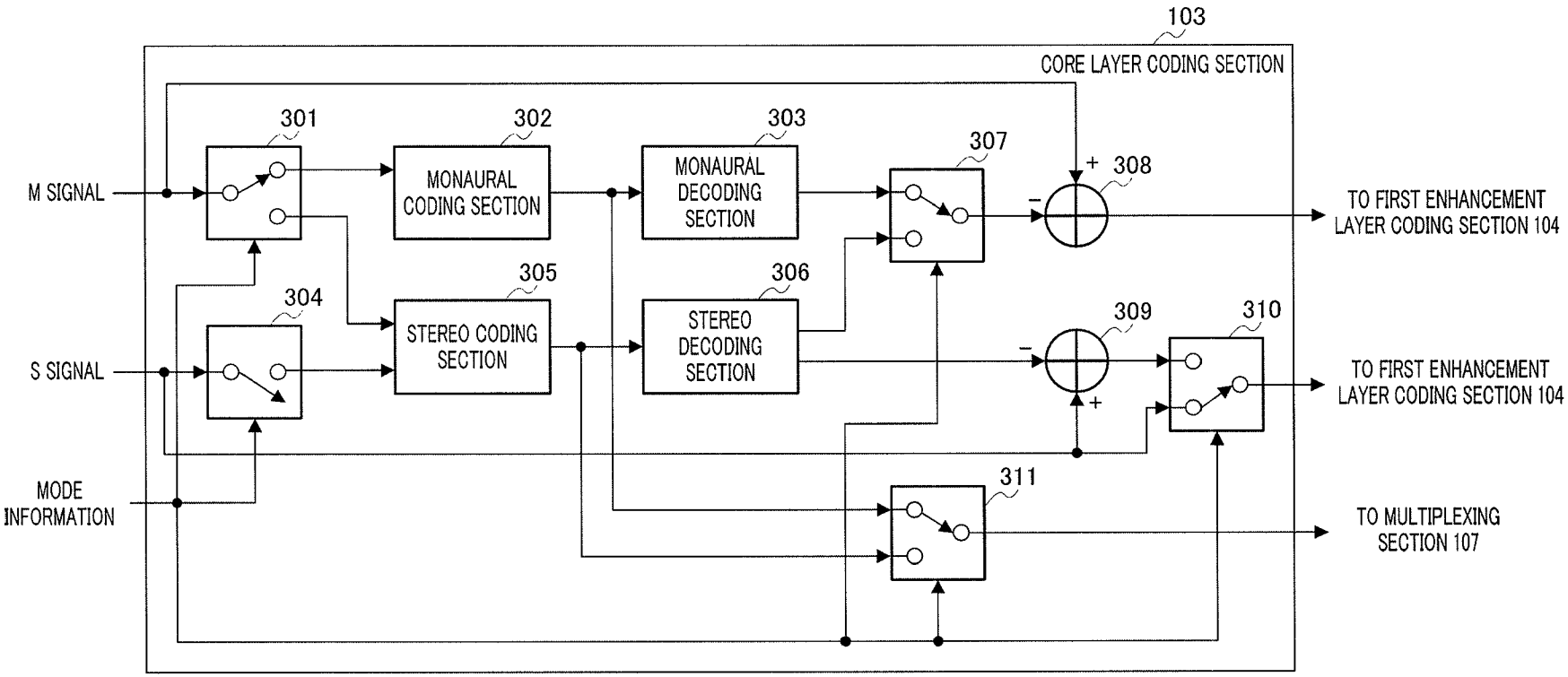
FIG. 3 illustrates the operations in a case where a monaural coding mode is set in a core layer coding section according to Embodiment 1 of the present invention.

FIG. 3 illustrates operations in a case where the monaural coding mode is set in core layer coding section 103 based on the value "0" of the first bit of mode information received as input from mode setting section 102.

As shown in FIG. 3, when the monaural coding mode is set in core layer coding section 103, stereo coding section 305, stereo decoding section 306 and adder 309 do not operate, and monaural coding section 302 and monaural decoding section 303 operate. Also, adder 308 finds a residual signal between the monaural decoded M signal received as input from monaural decoding section 303 via switch 307 and the M signal received as input from sum and difference calculating section 101, as the core layer coding distortion of the M signal. Also, switch 310 outputs the S signal received as input from sum and difference calculating section 101, as is to first enhancement layer coding section 104. Switch 311 outputs monaural encoded information received as input from monaural coding section 302, to multiplexing section 107 as core layer encoded information.

Figure 4:
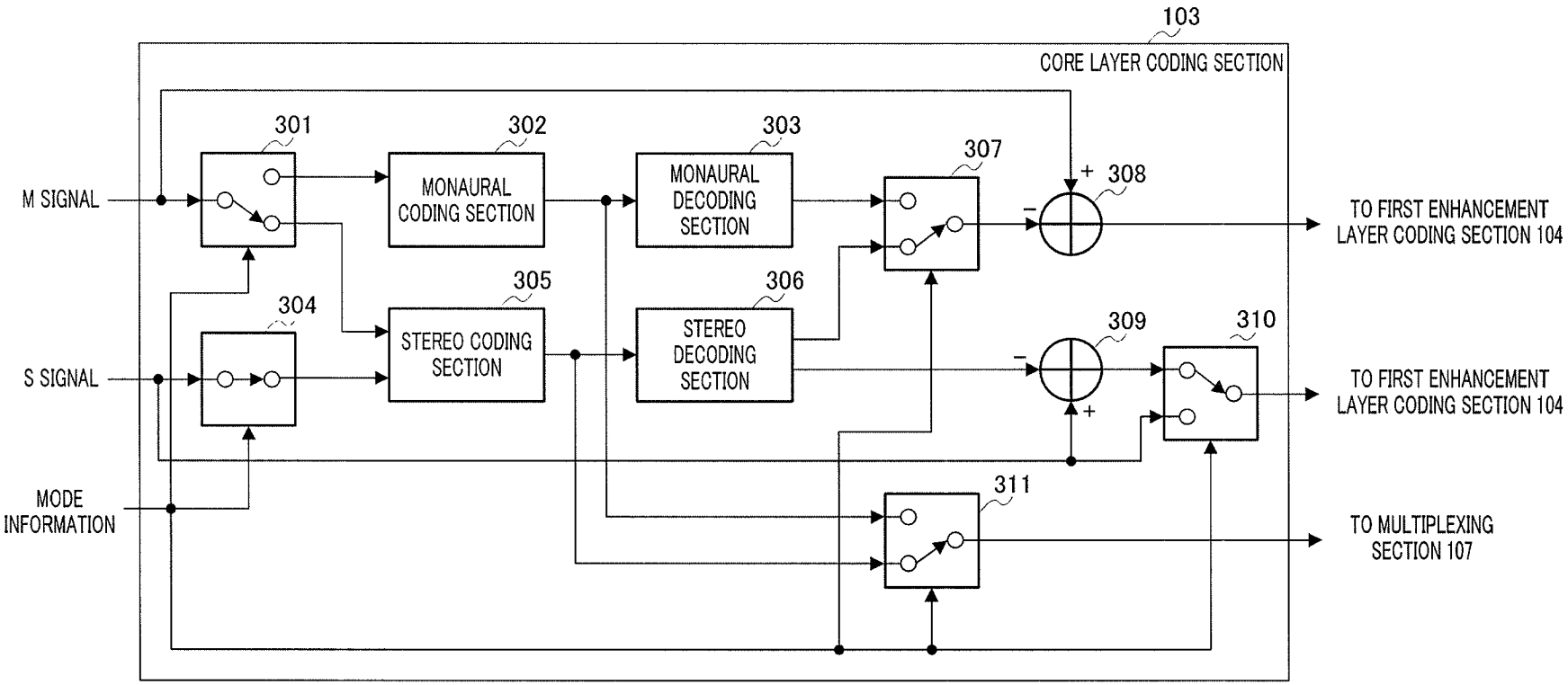
FIG. 4 illustrates the operations in a case where a stereo coding mode is set in a core layer coding section according to Embodiment 1 of the present invention.

FIG. 4 illustrates operations in a case where the stereo coding mode is set in core layer coding section 103 based on the value "1" of the first bit of mode information received as input from mode setting section 102.

As shown in FIG. 4, when the stereo coding mode is set in core layer coding section 103, monaural coding section 302 and monaural decoding section 303 do not operate, and stereo coding section 305, stereo decoding section 306 and adder 309 operate. Also, adder 308 finds a residual signal between the stereo decoded M signal received as input from stereo decoding section 306 and the M signal received as input from sum and difference calculating section 101, as the core layer coding distortion of the M signal. Also, switch 310 outputs the core layer coding distortion of the S signal received as input from adder 309, to first enhancement layer coding section 104. Switch 311 outputs stereo encoded information received as input from stereo coding section 305, to multiplexing section 107 as core layer encoded information.

Figure 5:
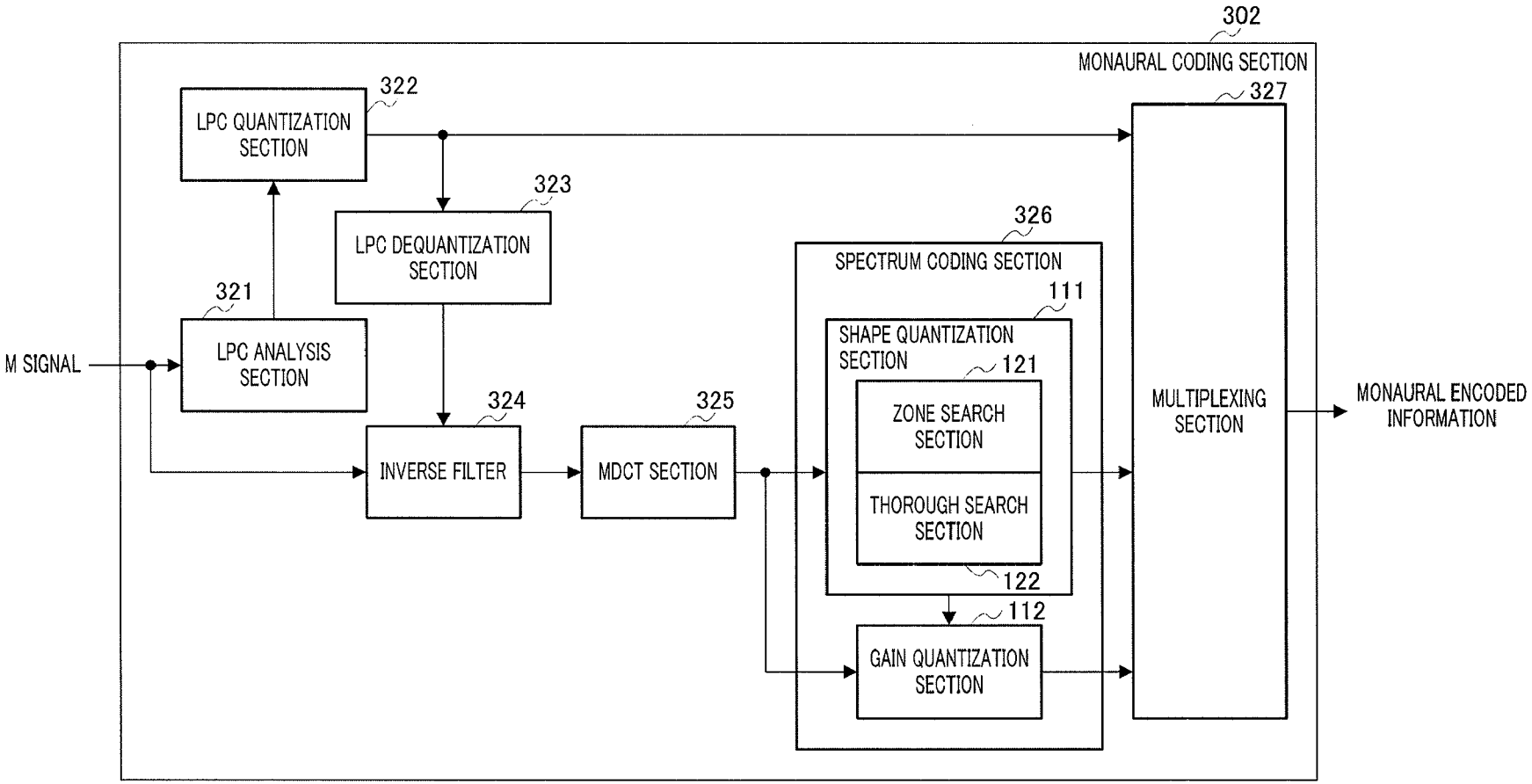
FIG. 5 is a block diagram showing the main components inside a monaural coding section according to Embodiment 1 of the present invention.

FIG. 5 is a block diagram showing the main components inside monaural coding section 302.

In FIG. 5, monaural coding section 302 is provided with LPC (Linear Prediction Coefficient) analysis section 321, LPC quantization section 322, LPC dequantization section 323, inverse filter 324, MDCT (Modified Discrete Cosine Transform) section 325, spectrum coding section 326 and multiplexing section 327. Spectrum coding section 326 includes shape quantization section 111 and gain quantization section 112, and shape quantization section 111 includes zone search section 121 and thorough search section 122.

LPC analysis section 321 performs a linear prediction analysis using the M signal received as input from sum and difference calculating section 101 via switch 301, and provides and outputs LPC parameters (i.e. linear prediction parameters) indicating an outline of the M signal spectrum to LPC quantization section 322.

LPC quantization section 322 converts the linear prediction parameters received as input from LPC analysis section 321, into parameters of good complementarity such as LSP's (Line Spectrum Pairs or Line Spectral Pairs) and ISP's (Immittance Spectrum Pairs), and quantizes the converted parameters by a quantization method such as VQ (Vector Quantization), predictive VQ, multi-stage VQ and split VQ. LPC quantization section 322 outputs LPC quantized data obtained by quantization, to LPC dequantization section 323 and multiplexing section 327.

LPC dequantization section 323 dequantizes the LPC quantized data received as input from LPC quantization section 322, and further inverts the resulting parameters such as LSP's and ISP's into LPC parameters.

Inverse filter 324 applies inverse filtering to the M signal received as input from sum and difference calculating section 101 via switch 301, using the LPC parameters received as input from LPC dequantization section 323, and outputs to MDCT section 325 the filtered M signal in which the spectrum-specific outline is removed and changed to a flat shape. Here, the function of inverse filter 324 is represented by following equation 3.

(Equation 3)

$$y_i = x_i + \sum_{j=1}^{J} \alpha_j \cdot x_{i-j} \quad [1]$$

In equation 3, subscript i represents the sample number of each signal, $x_i$ represents an input signal of inverse filter 324, and $y_i$ represents an output signal of inverse filter 324. Also, $a_i$ represents LPC parameters quantized and dequantized in LPC quantization section 322 and LPC dequantization section 323, and J represents the order of linear prediction.

MDCT section 325 performs an MDCT of the M signal subjected to inverse filtering, received as input from inverse filer 324, and transforms the time domain M signal into a frequency domain M signal spectrum. Also, instead of an MDCT, it is equally possible to use an FFT (Fast Fourier Transform). MDCT section 325 outputs the M signal spectrum obtained by an MDCT to spectrum coding section 326.

Spectrum coding section 326 receives the M signal spectrum as input from MDCT section 325, quantizes the spectral shape and gain of the input spectrum separately, and outputs the resulting pulse code and gain code to multiplexing section 327. Shape quantization section 111 quantizes the shape of the input spectrum in the positions and polarities of a small number of pulses, and gain quantization section 112 calculates and quantizes the gains of pulses searched out in shape quantization section 111, on a per band basis. Spectrum coding section 326 outputs a pulse code indicating the positions and polarities of searched pulses and a gain code representing the gain of the searched pulses, to multiplexing section 327. Also, shape quantization section 111 and gain quantization section 112 will be described later in detail.

Multiplexing section 327 provides monaural encoded information by multiplexing the LPC quantized data received as input from LPC quantization section 322 and the pulse code and gain code received as input from spectrum coding section 326, and outputs the monaural encoded information to monaural decoding section 303 and switch 311.

Next, shape quantization section 111 and gain quantization section 112 will be explained in detail. Shape quantization section 111 includes zone search section 121 that searches for pulses in each of a plurality of bands into which a predetermined search zone is divided, and thorough search section 122 that searches for pulses over the entire search zone.

Following equation 4 provides the reference of search. Here, in equation 4, E represents the coding distortion, $s_i$ represents the input spectrum, g represents the optimal gain, δ is the delta function, and p represents the pulse position.

(Equation 4)

$$E = \sum_i \{s_i - g\delta(i-p)\}^2 \quad [2]$$

From equation 4 above, the pulse position to minimize the cost function is the position in which the absolute value $|s_p|$ of the input spectrum in each band is maximum, and the polarity has the value of the input spectrum at that pulse position.

An example case will be explained below where the vector length of an input spectrum is eighty samples, the number of bands is five, and the spectrum is encoded using a total of eight pulses comprised of one pulse per band and three pulses in the entire zone. In this case, the length of each band is sixteen samples. Further, the amplitude of pulses to search for is fixed to "1," and their polarity is "+" or "−."

Zone search section 121 searches for the position of the maximum energy and its polarity (+/−) in each band, and allows one pulse to occur per band. In this example, the number of bands is five, and each band requires four bits to show the pulse position (entries of positions: 16) and one bit to show the polarity (+/−), requiring 25 information bits in total.

Figure 6:
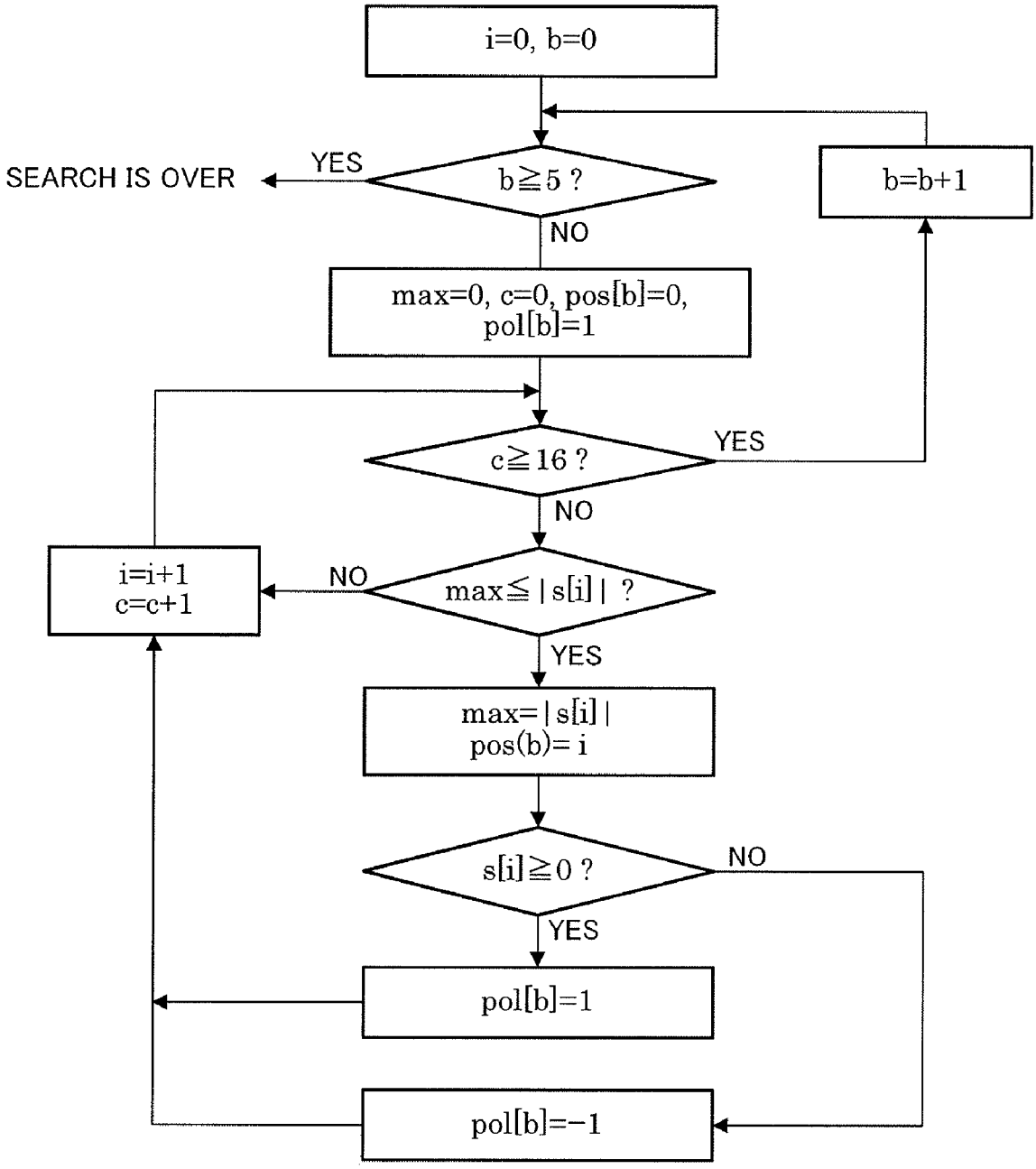
FIG. 6 is a flowchart showing a search algorithm in a zone search section according to Embodiment 1 of the present invention.

The flow of the search algorithm of zone search section 121 is shown in FIG. 6. Here, the symbols used in the flowchart of FIG. 6 stand for the following:

i: position
b: band number
max: maximum value
c: counter
pos[b]: search result (position)
pol[b]: search result (polarity)
s[i]: input spectrum As shown in FIG. 6, zone search section 121 calculates the input spectrum s[i] of each sample (0≦c≦15) per band (0≦b≦4), and calculates the maximum value "max."

Figure 7:
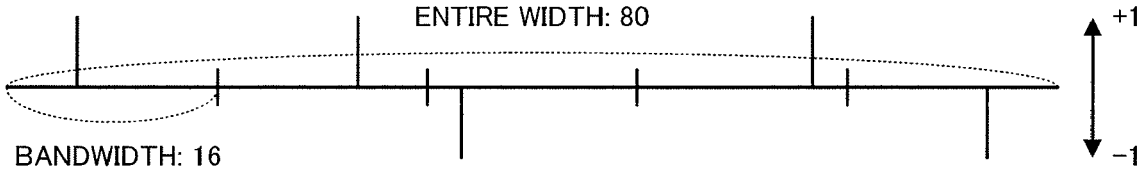
FIG. 7 shows an example of a spectrum represented by pulses searched out in a zone search section according to Embodiment 1 of the present invention.

FIG. 7 shows an example of a spectrum represented by pulses searched out in zone search section 121. As shown in FIG. 7, one pulse having an amplitude of "1" and polarity of "+" or "−" is placed in each of five bands each having a bandwidth of sixteen samples.

Thorough search section 122 searches for the positions to place three pulses, over the entire search zone, and encodes the pulse positions and their polarities. In thorough search section 122, a search is performed according to the following four conditions for encoding accurate positions with a small amount of information bits and a small amount of calculations.

(1) Two or more pulses are not placed in the same position. In this example, pulses are not placed in the positions in which the pulse of each band is placed in zone search section 121. With this ingenuity, information bits are not used to represent amplitude components, so that it is possible to use information bits efficiently.

(2) Pulses are searched for in order, on a one by one basis, in an open loop. During a search, according to the rule of (1), pulse positions having been determined are not subject to search.

(3) In a position search, a position in which a pulse is less preferable to be placed is also encoded as one position information.

(4) Given that gain is encoded on a per band basis, pulses are searched for by evaluating coding distortion with respect to the ideal gain of each band.

Thorough search section 122 performs the following two-step cost evaluation to search for a single pulse over the entire input spectrum. First, in the first step, thorough search section 122 evaluates the cost in each band and finds the position and polarity to minimize the cost function.

Then, in the second stage, thorough search section 122 evaluates the overall cost every time the above search is finished in a band, and stores the position and polarity of the pulse to minimize the cost, as a final result.

This search is performed per band, in order. Further, this search is performed to meet the above conditions (1) to (4). Then, when a search of one pulse is finished, assuming the presence of that pulse in the searched position, a search of the next pulse is performed. This search is performed until a predetermined number of pulses (three pulses in this example) are found, by repeating the above processing.

Figure 8:
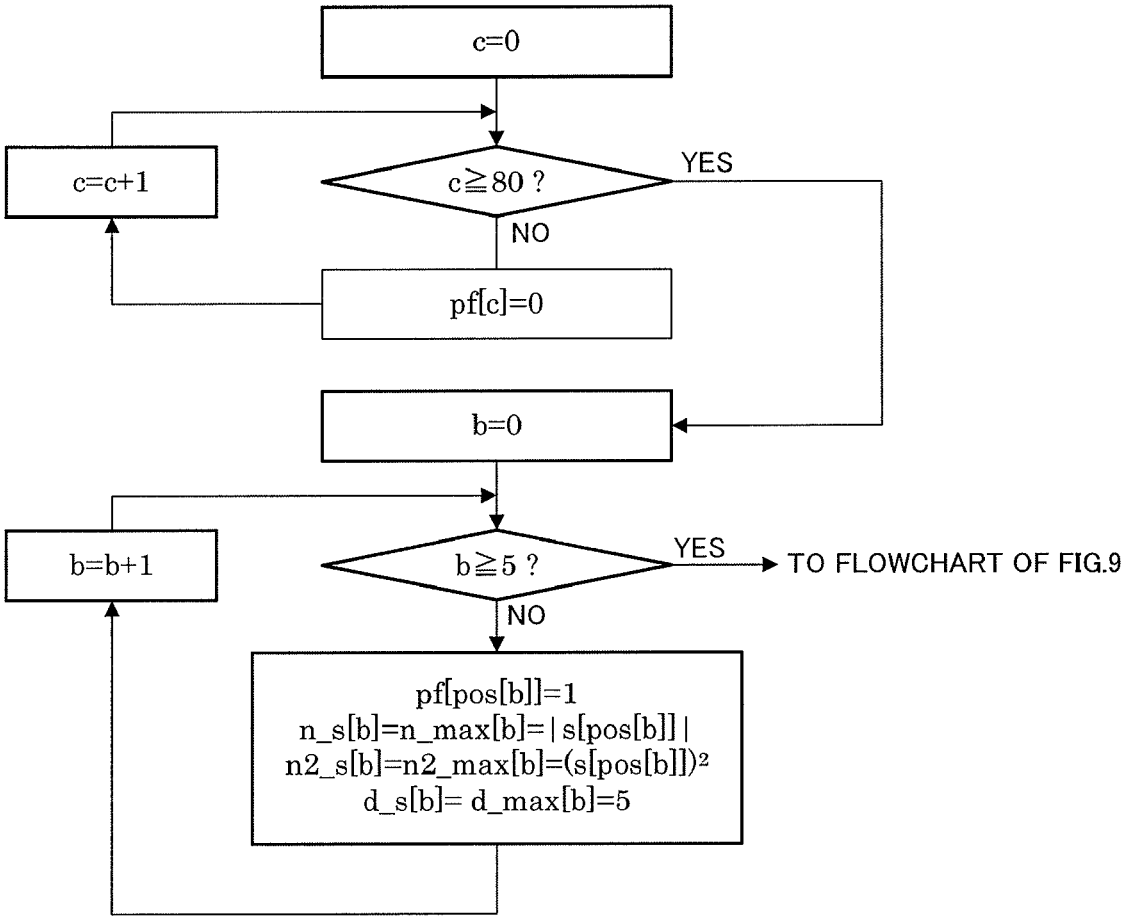
FIG. 8 is a flowchart showing preprocessing of a search algorithm in a thorough search section according to Embodiment 1 of the present invention.

The flow of the search algorithm in thorough search section 122 is shown in FIG. 8

Figure 9:
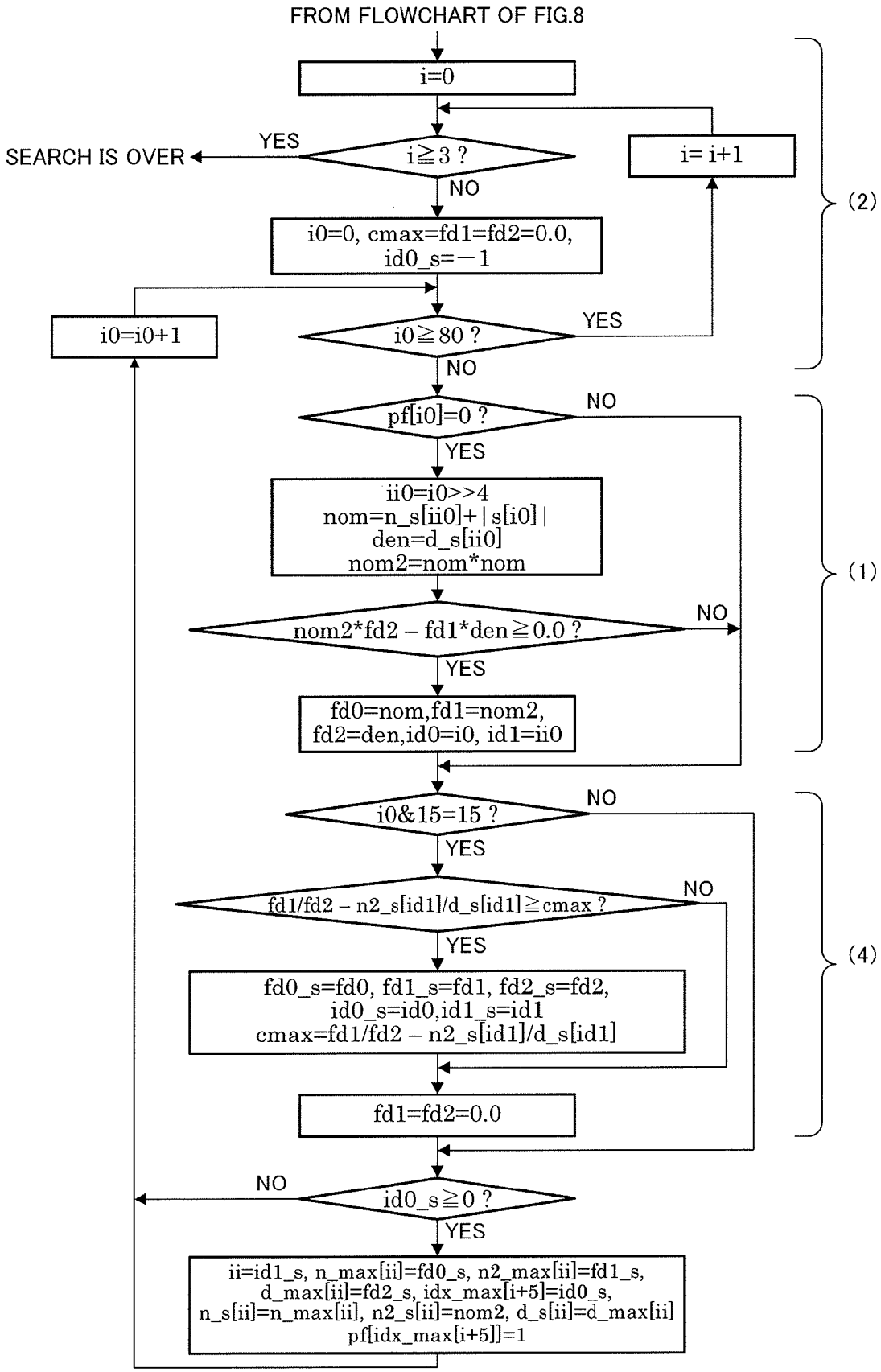
FIG. 9 is a flowchart showing a search by a search algorithm of a thorough search section according to Embodiment 1 of the present invention.

FIG. 8 is a flowchart of preprocessing of a search, and FIG. 9 is a flowchart of the search. Further, the parts corresponding to the above conditions (1), (2) and (4) are shown in the flowchart of FIG. 9.

The symbols used in the flowchart of FIG. 8 stand for the following:

c: counter
pf[*] pulse presence/non-presence flag
b: band number
pos[*]: search result (position)
n_s[*]: correlation value
n_max[*]: maximum correlation value
n2_s[*]: square correlation value
n2_max[*]: maximum square correlation value
d_s[*]: power value
d_max[*]: maximum power value
s[*]: input spectrum The symbols used in the flowchart of FIG. 9 stand for the following:

is pulse number
i0: pulse position
cmax: maximum value of cost function
Pf[*]: pulse presence/non-presence flag (0: non-presence, 1: presence)
ii0: relative pulse position in a band
nom: spectral amplitude
nom2: numerator term (spectral power)
den: denominator term
n_s[*]: relative value
d_s[*]: power value
s[*]: input spectrum
n2_s[*]: square correlation value
n_max[*]: maximum correlation value
n2_max[*]: maximum square correlation value
idx_max[*]: search result of each pulse (position) (here, idx_max[*] of 0 to 4 is equivalent to pos[b] of FIG. 6)
fd0, fd1, fd2: temporary storage buffer (real number type)
id0, id1: temporary storage buffer (integral number type)
id0_s, id1_s: temporary storage buffer (integral number type)
>>: bit shift (to the right)
&: "and" as a bit sequence Here, in the search in FIG. 8 and FIG. 9, the case where idx_max[*] is "−1," corresponds to the case of above condition (3) where a pulse is less preferable to be placed. A specific example of this is where a spectrum is sufficiently approximated only with pulses searched per band and pulses searched over the entire zone, and where further addition of pulses of the same magnitude increases coding distortion proportionally.

The polarities of the searched pulses correspond to the polarities of the input spectrum in these positions, and thorough search section 122 encodes these polarities with 3 (pulses)×1=3 bits. Here, when the position is "−1," that is, when a pulse is not be placed, either polarity can be used. However, the polarity may be used to detect bit error and generally is fixed to either "+" or "−."

Further, thorough search section 122 encodes pulse position information based on the number of combinations of pulse positions. In this example, since the input spectrum contains eighty samples and five pulses are already found in five individual bands, if cases where pulses are not placed are also taken into account, the variations of positions can be represented using seventeen bits, by the calculation of following equation 5.

(Equation 5)

$$\begin{aligned} {}_{75+1}C_3 &= (75+1)*(74+1)*(73+1)/3/2/1 \\ &= 70300 < 131072 \\ &= 2\text{^}17 \end{aligned} \quad [3]$$

Here, according to the rule of not allowing two or more pulses to be placed in the same position, it is possible to reduce the number of combinations, so that the effect of this rule becomes greater when the number of pulses thoroughly searched out increases.

The method of encoding the positions of pulses searched out in thorough search section 122 will be described below in detail.

(1) Three pulse positions are sorted based on their magnitude and arranged in order from the lowest numerical value to the highest numerical value. Here, "−1" is left as is.

(2) The pulse numbers are left-aligned by the number of pulses having occurred in individual bands, to reduce the numerical values of the pulse positions. Numerical values calculated in this way are referred to as "position numbers." Here, "−1" is left as is. For example, referring to the pulse position of "66," when one pulse each is provided between 0 and 15, between 16 and 31, between 32 and 47, and between 48 and 64, the position number is changed to "66−4=62."

(3) "−1" is set to the position number represented by "the maximum value of a pulse +1." In this case, the order of values is adjusted and determined such that the set position number is not confused with a position number in which a pulse is actually present. By this means, the pulse number of pulse #0 is limited to the range between 0 and 73, the position number of pulse #1 is limited to the range between the position number of pulse #0 and 74, and the position number of pulse #2 is limited to the range between the position number of pulse #1 and 75, that is, the position number of a lower pulse is designed not to exceed the position number of a higher pulse.

(4) Then, according to integration processing shown in following equation 6 to calculate a combination code, position numbers (i0, i1, i2) are integrated to produce code (c). This integration processing refers to the calculation processing of integrating all combinations in a case where there is the order of magnitude.

[4]

$$c=((76-0)*(77-0)*(153-2*0)/3+(74-0)*(75-0))/4-((76-i0)*(77-i0)*(153-2*i0)/3+(74-i0)*(75-i0))/4;$$

$$c=c+(76-i0)*(77-i0)/2-(76-i1)*(77-i1)/2;$$

$$c=c+75-i2 \quad \text{(Equation 6)}$$

(5) Then, by combining the seventeen bits of this c and three bits for polarity, a code of twenty bits is produced.

Here, in the above position numbers, pulse #0 in "73," pulse #1 in "74" and pulse #2 in "75" are position numbers in which pulses are not placed. For example, if there are three position numbers (73, −1, −1), according to the above relationship between one position number and the position number in which a pulse is not placed, these position numbers are reordered to (−1, 73, −1) and made (73, 73, 74).

Thus, with a model to represent an input spectrum by a sequence of eight pulses (five pulses in individual bands and three pulses in the entire zone) as shown in this example, it is possible to perform coding by 45 information bits.

Figure 10:
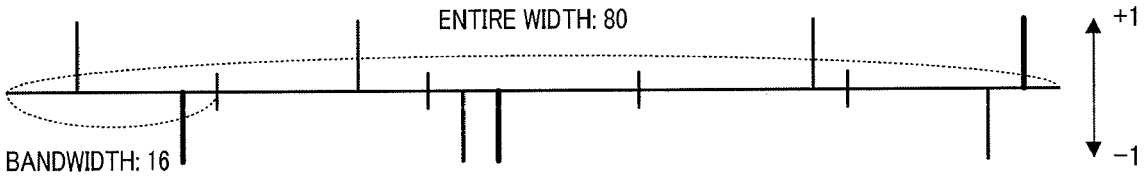
FIG. 10 illustrates an example of a spectrum represented by pulses searched out in a zone search section and thorough search section according to Embodiment 1 of the present invention.

FIG. 10 illustrates an example of a spectrum represented by pulses searched out in zone search section 121 and thorough search section 122. Also, in FIG. 10, the pulses represented by bold lines are pulses searched out in thorough search section 122.

Gain quantization section 112 quantizes the gain of each band. Eight pulses are placed in the bands, and gain quantization section 112 calculates the gains by analyzing the correlation between these pulses and the input spectrum.

If gain quantization section 112 calculates the ideal gains and then perform coding by scalar quantization or vector quantization, first, gain quantization section 112 calculates the ideal gains according to following equation 7. Here, in equation 7, $g^n$ is the ideal gain of band n, s(i+16n) is the input spectrum of band n, $v^n(i)$ is the vector acquired by decoding the shape of band n.

(Equation 7)

$$g^n = \frac{\sum_i s(i+16n) \times v^n(i)}{\sum_i v^n(i) \times v^n(i)} \quad [5]$$

Further, gain quantization section 112 performs coding by performing scalar quantization ("SQ") of the ideal gains or performing vector quantization of these five gains together. In the case of performing vector quantization, it is possible to perform efficient coding by prediction quantization, multistage VQ, split VQ, and so on. Here, gain can be heard perceptually based on a logarithmic scale, and, consequently, by performing SQ or VQ after performing logarithmic conversion of gain, it is possible to provide perceptually good synthesis sound.

Further, instead of calculating ideal gains, there is a method of directly evaluating coding distortion. For example, in the case of performing VQ of five gains, coding distortion is calculated to minimize following equation 8. Here, in equation 8, $E_k$ is the distortion of the k-th gain vector, s(i+16n) is the input spectrum of band n, $g_n^{(k)}$ is the n-th element of the k-th gain vector, and $v^n(i)$ is the shape vector acquired by decoding the shape of band n.

(Equation 8)

$$E_k = \sum_n \sum_i \{s(i+16n) - g_n^{(k)} v^n(i)\} \quad [6]$$

Figure 11:
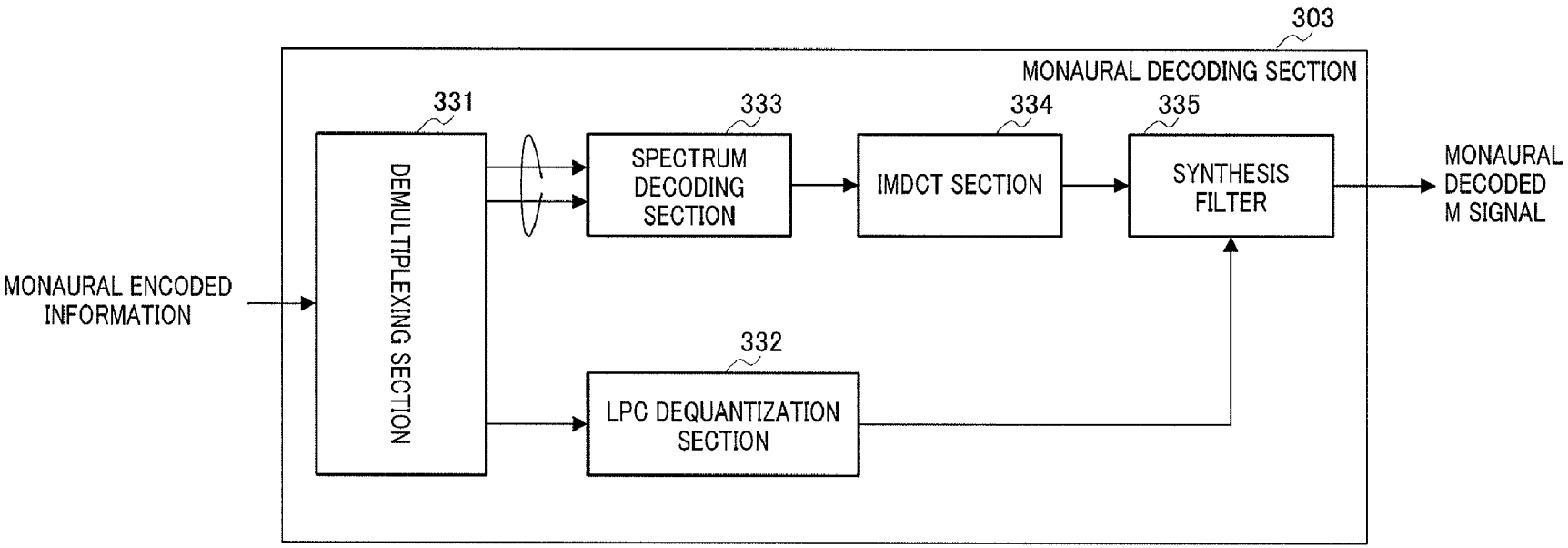
FIG. 11 is a block diagram showing the main components inside a monaural decoding section according to Embodiment 1 of the present invention.

FIG. 11 is a block diagram showing the main components inside monaural decoding section 303. Monaural decoding section 303 shown in FIG. 11 is provided with demultiplexing section 331, LPC dequantization section 332, spectrum decoding section 333, IMDCT (Inverse Modified Discrete Cosine Transform) section 334 and synthesis filter 335.

In FIG. 11, demultiplexing section 331 demultiplexes monaural encoded information received as input from monaural coding section 302, into the LPC quantized data, the pulse code and the gain code, outputs the LPC quantized data to LPC dequantization section 332 and outputs the pulse code and gain code to spectrum decoding section 333.

LPC dequantization section 332 dequantizes the LPC quantized data received as input from demultiplexing section 331, and outputs the resulting LPC parameters to synthesis filter 335.

Spectrum decoding section 333 decodes the shape vector and decoding gain by a method supporting the coding method in spectrum coding section 326 shown in FIG. 5, using the pulse code and gain code received as input from demultiplexing section 331. Further, spectrum decoding section 333 provides a decoded spectrum by multiplying the decoded shape vector by the decoding gain, and outputs this decoded spectrum to IMDCT section 334.

IMDCT section 334 transforms the decoded spectrum received as input from spectrum decoding section 333 in an opposite manner to transform in MDCT section 325 shown in FIG. 5, and outputs the time-series M signal acquired by transform to synthesis filter 335.

Synthesis filter 335 provides a monaural decoded M signal by applying the synthesis filter to the time-series M signal received as input from IMDCT section 334, using the LPC parameters received as input from LPC dequantization section 332.

Next, the method of decoding three pulses in spectrum decoding section 333, which are thoroughly searched out, will be explained.

Figure 12:
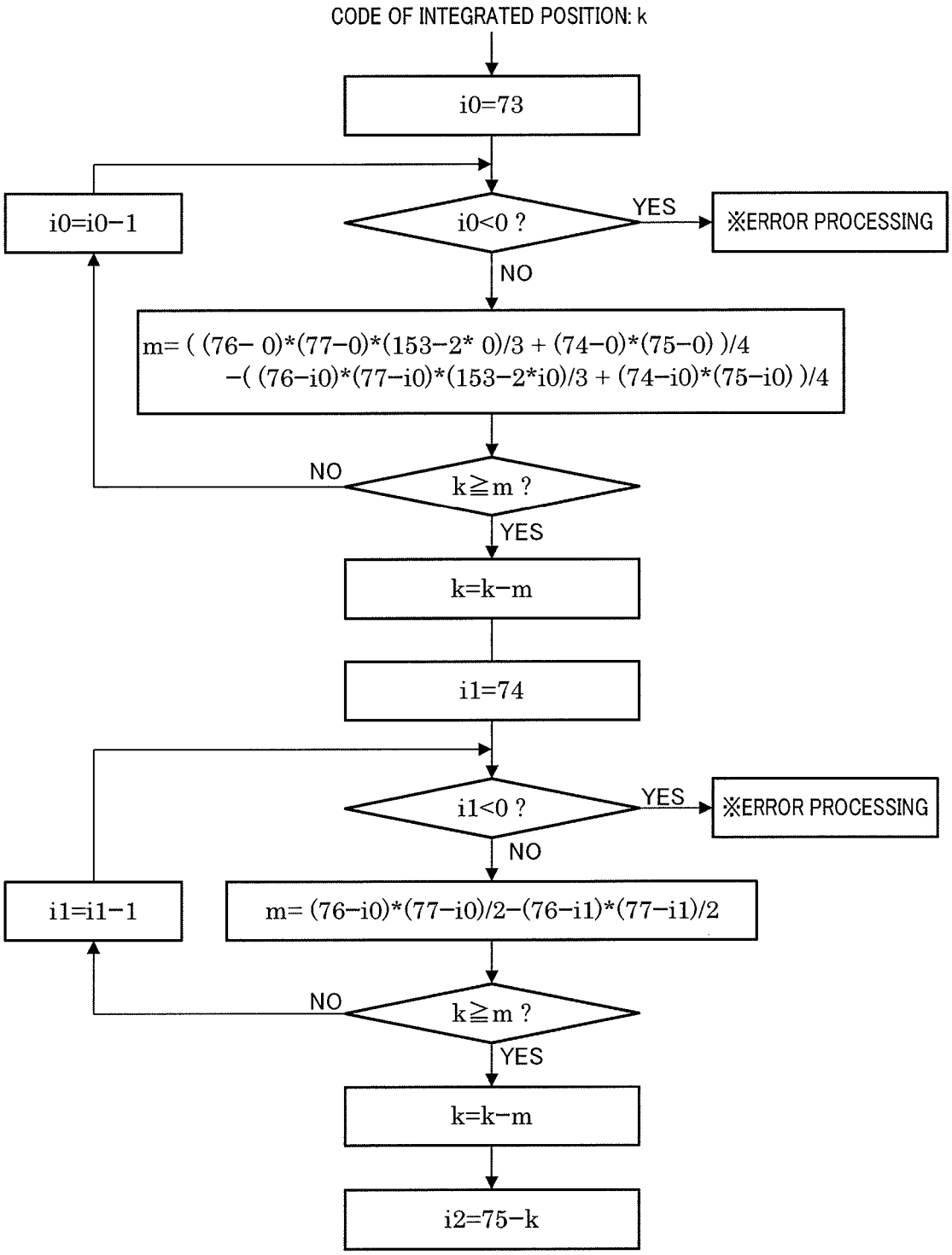
FIG. 12 is a flowchart showing a decoding algorithm of a spectrum decoding section according to Embodiment 1 of the present invention.

In thorough search section 122 of spectrum coding section 326, position numbers (i0, i1, i2) are integrated to one code using above equation 5. In spectrum decoding section 333, opposite processing is performed. That is, spectrum decoding section 333 sequentially calculates the value of the integration equation while changing each position number, fixes the position number when the position number is lower than the integration value, and performs decoding by performing this processing from the position number of lower order to the position number of higher order one by one. FIG. 12 is a flowchart showing the decoding algorithm of spectrum decoding section 333.

Further, in FIG. 12, when input code "k" of the integrated position involves error due to bit error, the flow proceeds to the step of error processing. Therefore, in this case, the position has to be found by predetermined error processing.

Further, since the decoder performs loop processing, the amount of calculations in the decoder is greater than in the encoder. Here, each loop is an open loop, and, consequently, as compared with the overall amount of processing in the coding apparatus, the amount of calculations in the decoder is not so large.

Figure 13:
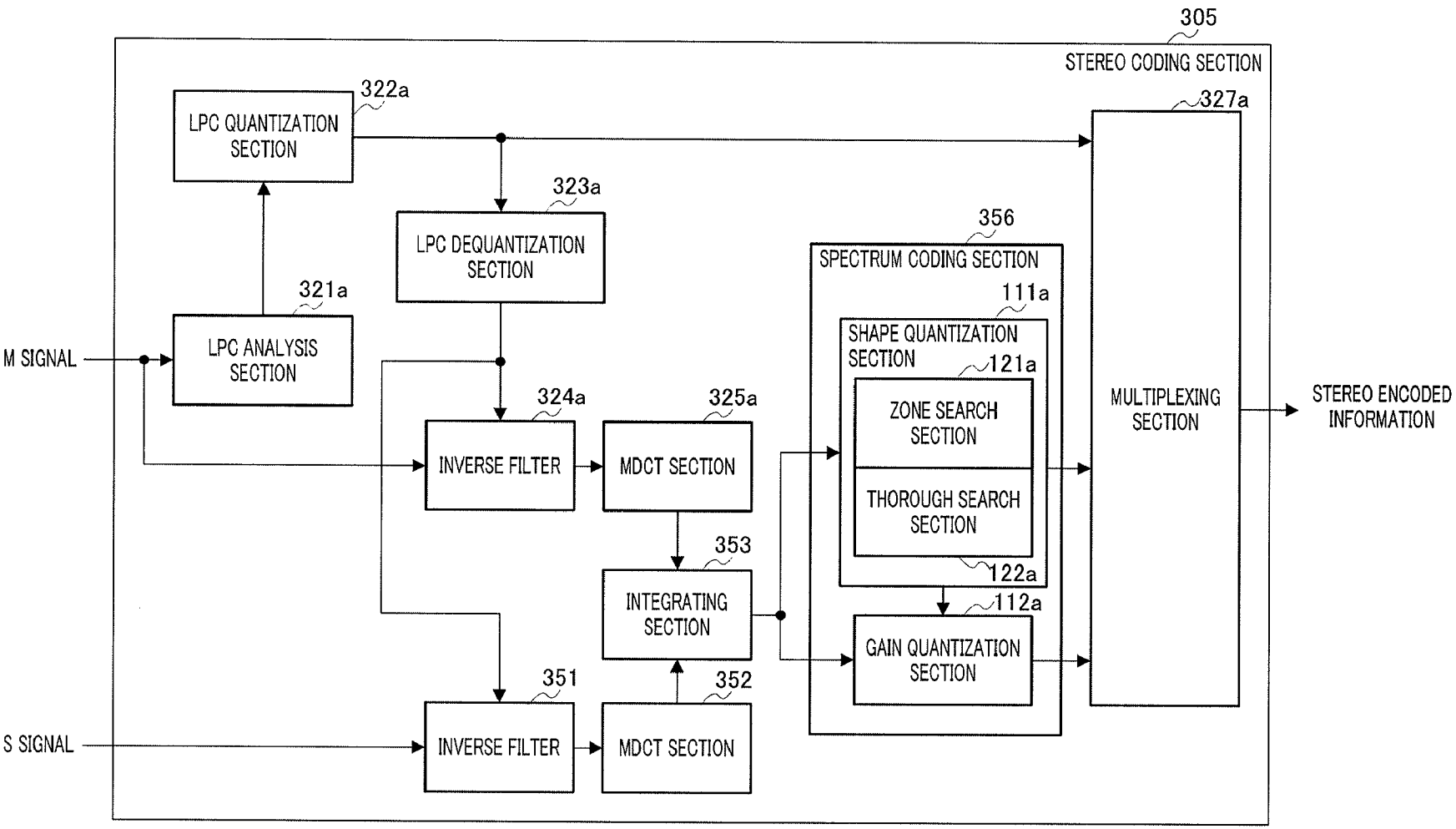
FIG. 13 is a block diagram showing the main components inside a stereo coding section according to Embodiment 1 of the present invention.

FIG. 13 is a block diagram showing the main components inside stereo coding section 305. Stereo coding section 305 shown in FIG. 13 has basically the same configuration and performs basically the same operations as monaural coding section 302 shown in FIG. 5. Consequently, as for sections that perform the same operations between FIG. 5 and FIG. 13, "a" is assigned to the reference numerals of the sections in FIG. 13. For example, a section in FIG. 13 corresponding to LPC analysis section 321 in FIG. 5 is expressed as LPC analysis section 321*a*. Also, stereo coding section 305 in FIG. 13 differs from monaural coding section 302 in FIG. 5 in further including inverse filter 351, MDCT section 352 and integrating section 353. Also, spectrum coding section 356 of stereo coding section 305 in FIG. 13 differs from spectrum coding section 326 of monaural coding section 302 in FIG. 5 in input signals, and is therefore assigned a different reference numeral.

Inverse filter 351 applies inverse filtering to the S signal received as input from sum and difference calculating section 101, using LPC parameters received as input from LPC dequantization section 323*a*, to make the spectrum-specific outline smooth, and outputs the filtered S signal to MDCT section 352. Here, the function of inverse filter 324*a* is represented by above equation 3. Strictly speaking, although LPC coefficients obtained from the M signal do not match the spectral outline of the S signal, taking into account that the M signal and the S signal generally have similar spectral outlines and that the amount of calculations and ROM amount required for LPC analysis, quantization and dequantization of the S signal are saved, LPC parameters received as input from LPC dequantization section 323*a* are used in inverse filtering processing in inverse filter 351.

MDCT section 352 performs an MDCT of the S signal subjected to inverse filtering received as input from inverse filter 351, and transforms the time domain S signal into a frequency domain S signal spectrum. Here, instead of an MDCT, it is equally possible to use an FFT. MDCT section 352 outputs the S signal spectrum acquired by an MDCT to integrating section 353.

Integrating section 353 integrates the M signal spectrum received as input from MDCT section 325*a* and the S signal spectrum received as input from MDCT section 352 such that spectrums of the same frequency are adjacent to each other, and outputs the resulting integrated spectrum to spectrum coding section 356.

Figure 14:
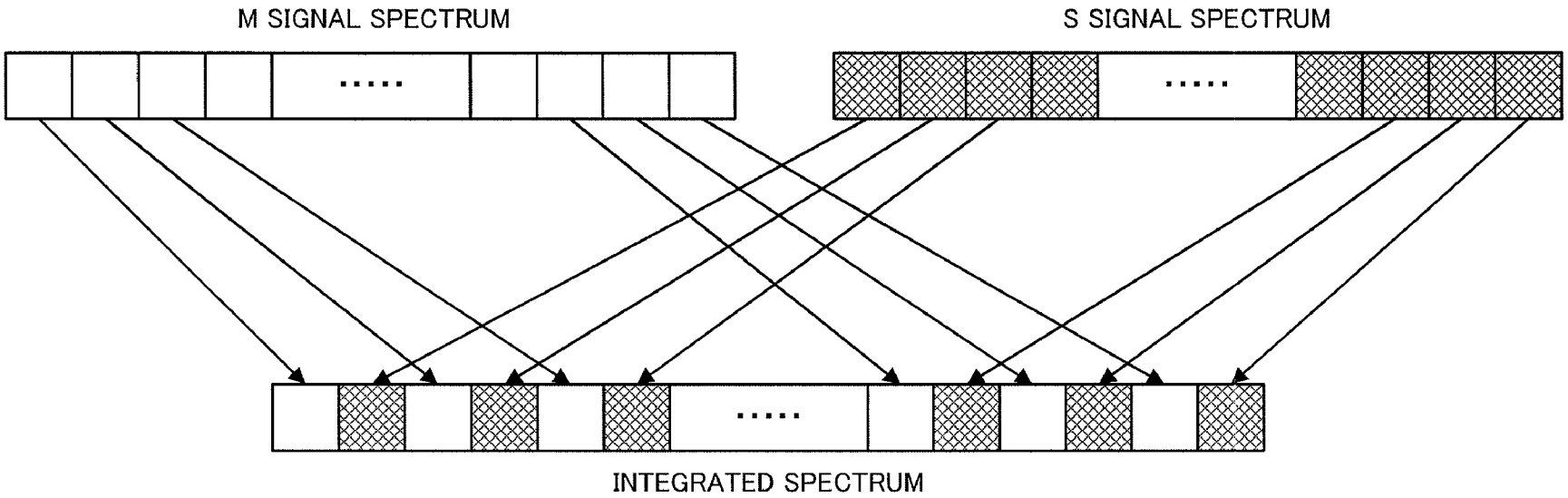
FIG. 14 illustrates a state where an M signal spectrum and S signal spectrum are integrated in an integrating section according to Embodiment 1 of the present invention.

FIG. 14 illustrates a state where the M signal spectrum and the S signal spectrum are integrated in integrating section 353. Spectrum coding section 356 uses an integrated spectrum acquired by integrating two spectrums as shown in FIG. 14 as one coding target spectrum, and therefore allocates more bits to important parts in coding of the M signal spectrum and S signal spectrum.

Referring back to FIG. 13, spectrum coding section 356 differs from spectrum coding section 326 in using an integrated spectrum received as input from integrating section 353 as an input spectrum. Also, spectrum coding section 356 differs from spectrum coding section 326 in the number of pulses searched out over the entire input spectrum.

In association with the number of pulses searched out thoroughly, bit allocation in spectrum coding section 356 will be explained with reference to FIG. 15.

Spectrum coding section 356 uses an integrated spectrum as an input spectrum, and, consequently, the number of samples in the input spectrum is twice the input spectrum in spectrum coding section 326, and the number of samples in each of five bands acquired by dividing the input spectrum is twice as in spectrum coding section 326. Taking into account that a total number of bits of a shape code is 45 bits in monaural coding section 302, spectrum coding section 356 performs bit allocation as shown in FIG. 15. As shown in FIG. 15, the number of pulses searched out thoroughly is "2" in spectrum coding section 356, which is different from spectrum coding section 326 in which the number of pulses searched out thoroughly is "3."

Also, as shown in FIG. 15, the number of bits to use in spectrum coding is "46" in total in spectrum coding section 356, which is different from spectrum coding section 326 in which the number of bits to use in spectrum coding is "45" in total.

Here, it is equally possible to completely match a total number of bits to use in spectrum coding in spectrum coding section 356, with a total number of bits to use in spectrum coding in spectrum coding section 326. For example, the search range for one of two pulses searched out thoroughly in spectrum coding section 356 may be limited from 0 to 159 samples, to 0 to 50 samples. By this means, it is possible to express $160\times51<8192$ kinds of search results by 13 bits, so that it is possible to suppress a total number of bits to use in spectrum coding within 45 bits. Alternatively, for example, upon searching for a pulse per band, by limiting the search range of the fifth band (i.e. the highest band) from 0 to 31 samples, to 0 to 15 samples, it is equally possible to completely match a total number of bits to use in spectrum coding in spectrum coding section 356, with a total number of bits to use in spectrum coding in spectrum coding section 326. This is because, in this case, it is possible to represent the band pulse positions in five bands by $5\times4+4=24$ bits.

If spectrum coding section 356 encodes an integrated spectrum integrating the M signal spectrum and S signal spectrum, bit allocation is automatically performed based on the features of the M signal and S signal, so that it is possible to perform efficient coding according to the significance of information.

For example, if the L signal and the R signal are completely the same, the S signal spectrum is "0" and pulses are placed only in positions of the M signal spectrum in the integrated spectrum. Consequently, the M signal spectrum is encoded accurately.

By contrast, if the L signal phase and the R signal phase are approximately opposite, the S signal spectrum becomes significant and more pulses are placed in positions of the S signal spectrum in the integrated spectrum. Consequently, the S signal spectrum is encoded accurately. Thus, without special decision or case classification, bit allocation is automatically performed, and the M signal spectrum and the S signal spectrum are encoded efficiently.

Also, if there are large elements in certain frequency and the L signal phase and R signal phase are not approximately opposite, one of the M signal spectrum and the S signal spectrum is likely to have large elements. Here, the M signal spectrum and S signal spectrum of the same frequency elements are integrated side by side into an integrated spectrum, and the integrated spectrum is divided into a plurality of bands and encoded in spectrum coding section 356, so that only one of the M signal spectrum and the S signal spectrum of frequency with significant elements is searched and encoded. By this means, it is possible to avoid encoding two pulses of the same frequency element and realize efficient coding.

Figure 16:
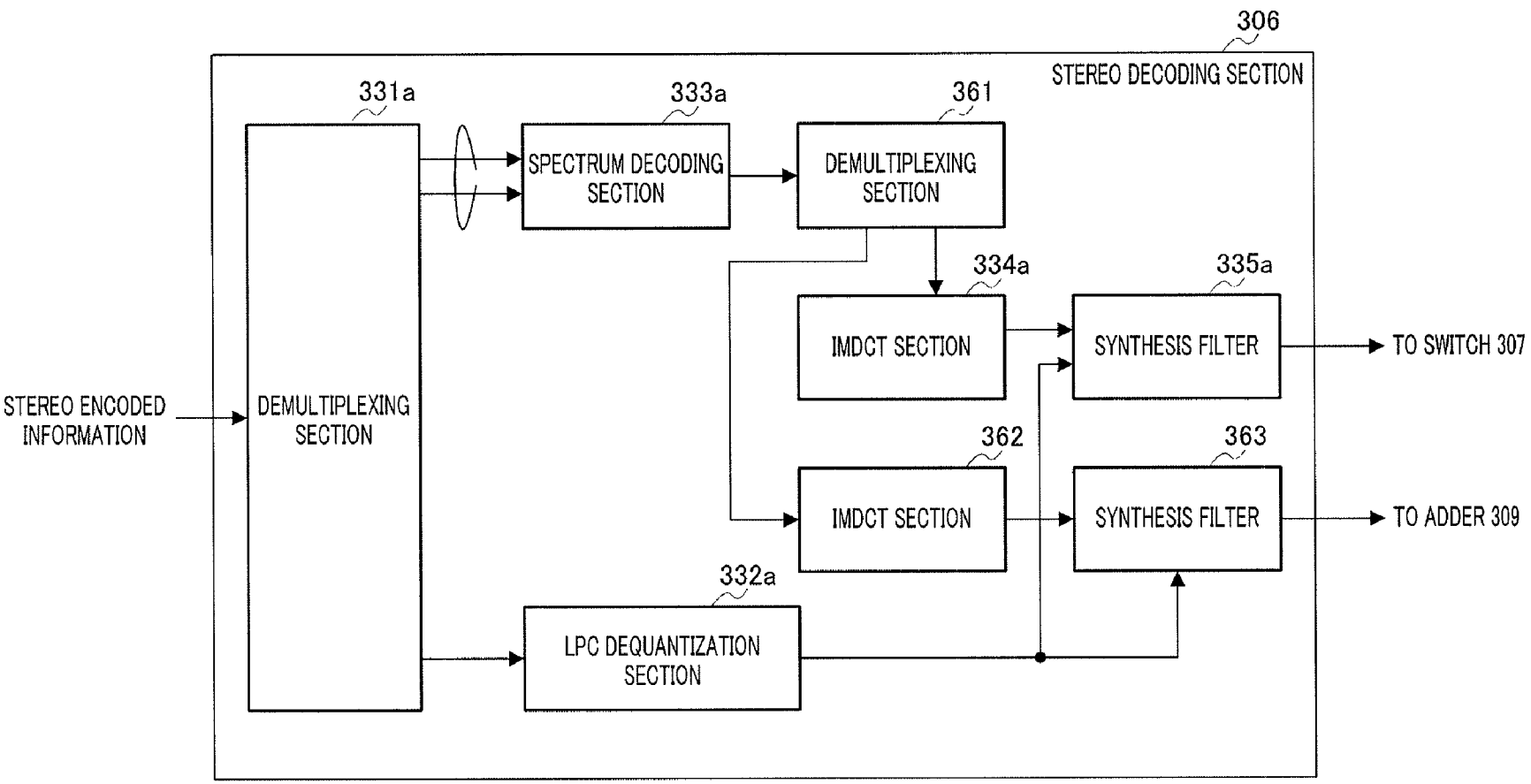
FIG. 16 is a block diagram showing the main components inside a stereo decoding section according to Embodiment 1 of the present invention.

FIG. 16 is a block diagram showing the main components inside stereo decoding section 306. Stereo decoding section 306 is provided with demultiplexing section 331*a*, LPC dequantization section 332*a*, spectrum decoding section 333*a*, IMDCT section 334*a* and synthesis filter 335*a*, which perform the same operations as demultiplexing section 331, LPC dequantization section 332, spectrum decoding section 333, IMDCT section 334 and synthesis filter 335 of monaural decoding section 303 shown in FIG. 11. Further, stereo decoding section 306 is provided with decomposing section 361, IMDCT section 362 and synthesis filter 363. Also, in FIG. 16, an output signal of synthesis filter 335*a* is the stereo decoded M signal, and an output signal of synthesis filter 363 is the stereo decoded S signal.

Decomposing section 361 decomposes a decoded spectrum received as input from spectrum decoding section 333*a*, into the decoded M signal spectrum and the decoded S signal spectrum by opposite processing to processing in integrating section 353 in FIG. 13. Further, decomposing section 361 outputs the decoded M signal spectrum to IMDCT section 334*a* and outputs the decoded S signal spectrum to IMDCT section 362.

IMDCT section 362 transforms the decode S signal spectrum received as input from decomposing section 361, in an opposite manner to MDCT section 352 shown in FIG. 13, and outputs the time-series S signal acquired by transform to synthesis filter 363.

Synthesis filter 363 provides a stereo decoded S signal by applying a synthesis filter to the time-series S signal received as input from IMDCT section 362, using LPC parameters received as input from LPC dequantization section 332*a*.

Next, the configuration and operations of the stereo signal decoding apparatus supporting stereo signal coding apparatus 100 shown in FIG. 1, will be explained.

Figure 17:
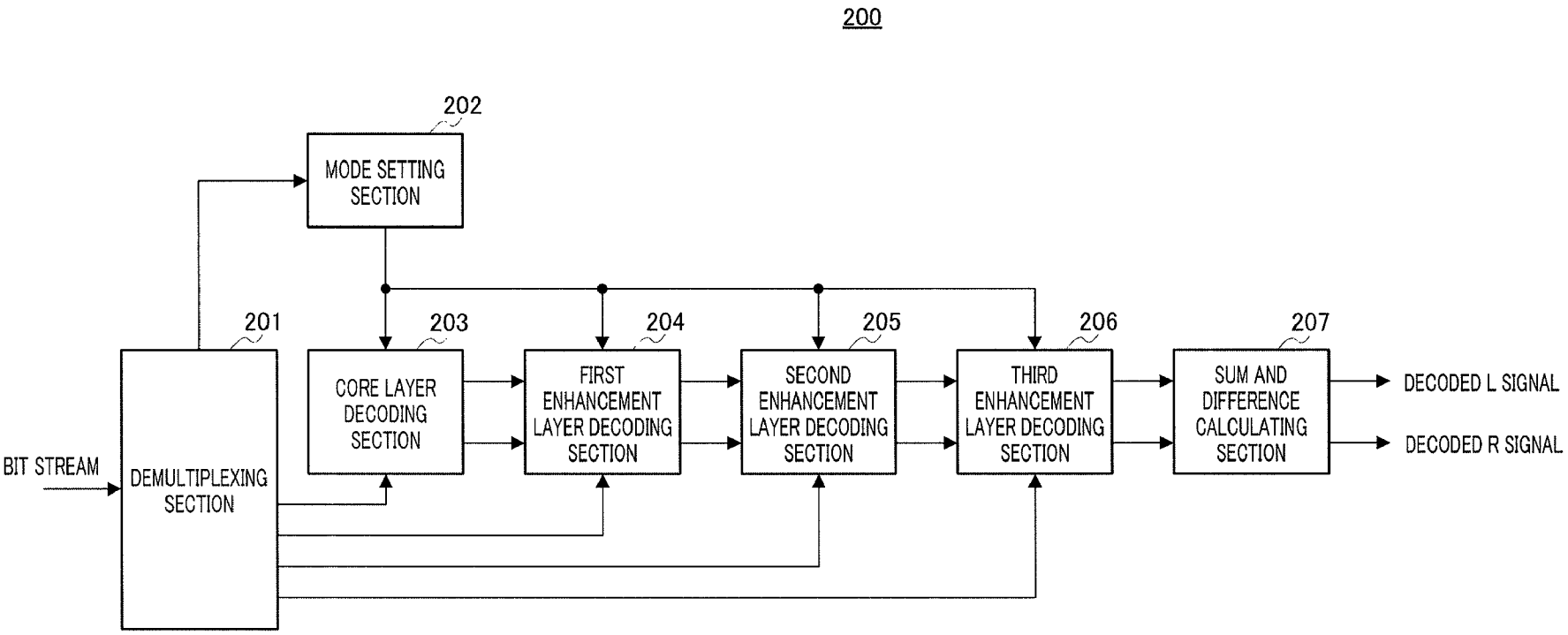
FIG. 17 is a block diagram showing the main components of a stereo signal decoding apparatus according to Embodiment 1 of the present invention.

FIG. 17 is a block diagram showing the main components of stereo signal decoding apparatus 200 supporting stereo signal coding apparatus 100.

In FIG. 17, stereo signal decoding apparatus 200 is provided with demultiplexing section 201, mode setting section 202, core layer decoding section 203, first enhancement layer decoding section 204, second enhancement layer decoding section 205, third enhancement layer decoding section 206 and sum and difference calculating section 207.

Demultiplexing section 201 demultiplexes bit streams received as input from stereo signal coding apparatus 100, into the mode information, the core layer encoded information, the first enhancement layer encoded information, the second enhancement layer encoded information and the third enhancement layer encoded information, and outputs these to mode setting section 202, core layer decoding section 203, first enhancement layer decoding section 204, second enhancement layer decoding section 205 and third enhancement layer decoding section 206, respectively.

Mode setting section 202 output the mode information for setting the decoding modes in core layer decoding section 203, first enhancement layer decoding section 204, second enhancement layer decoding section 205 and third enhancement layer decoding section 206, received as input from demultiplexing section 201, to these decoding sections.

The decoding mode in each decoding section refers to a monaural decoding mode for decoding only M signal information, or a stereo decoding mode for decoding both M signal information and S signal information. Here, M signal information representatively refers to the M signal itself or coding distortion related to the M signal in each layer. Also, S signal information representatively refers to the S signal itself or coding distortion related to the S signal in each layer.

In the following, the decoding mode in each layer will be shown using each of the bits of mode information. That is, in the bits, the value "0" represents the monaural decoding mode, and the value "1" represents the stereo decoding mode. To be more specific, for example, each of the four bits of mode information is used to sequentially represent the decoding modes in core layer decoding section 203, first enhancement layer decoding section 204, second enhancement layer decoding section 205 and third enhancement layer decoding section 206. For example, four-bit-mode information "0000" means that monaural decoding is performed in all layers. Also, for example, mode information "0011" means that core layer decoding section 203 and first enhancement layer decoding section 204 performs monaural decoding, and second enhancement layer decoding section 205 and third enhancement layer decoding section 206 performs stereo decoding. Thus, with four-bit-mode information, it is possible to represent sixteen types of decoding modes in four decoding sections.

With the present embodiment, mode information outputted from mode setting section 202 is received in each decoding section as the same input four-bit-mode information. Further, each decoding section checks only one bit of the four input bits required to set the decoding mode, and sets the decoding mode. That is, in the input four-bit-mode information, core layer decoding section 203 checks the first bit, first enhancement layer decoding section 204 checks the second bit, second enhancement layer decoding section 205 checks the third bit, and third enhancement layer decoding section 206 checks the fourth bit.

However, instead of inputting the same four-bit-mode information in each decoding section, mode setting section 202 may sort in advance the single bit required to set the decoding mode in each decoding section, and output one bit to each decoding section. That is, in four bits of mode information, mode setting section 202 may input only the first bit in core layer decoding section 203, only the second bit in first enhancement layer decoding section 204, only the third bit in second enhancement layer decoding section 205, and only the fourth bit in third enhancement layer decoding section 206.

Also, in any of the above cases, mode information received as input from demultiplexing section 201 to mode setting section 202 refers to four-bit-mode information.

In core layer decoding section 203, either the monaural decoding mode or the stereo decoding mode is set based on mode information received as input from mode setting section 202. To be more specific, upon setting the monaural decoding mode, core layer decoding section 203 decodes monaural encoded information received from demultiplexing section 201 as input core layer encoded information, and outputs the resulting core layer decoded M signal to first enhancement layer decoding section 204. In this case, S signal information is not decoded, and, consequently, a zero signal is apparently outputted to first enhancement layer decoding section 204 as a core layer decoded S signal.

In contrast, upon setting the stereo decoding mode, core layer decoding section 203 decodes stereo encoded information received from demultiplexing section 201 as input core layer encoded information, and outputs the resulting core layer decoded M signal and core layer decoded S signal to first enhancement layer decoding section 204. Here, core layer decoding section 203 clears all the M signal and S signal (i.e. puts 0 values in these signals) before decoding. Also, core layer decoding section 203 will be described later in detail.

In first enhancement layer decoding section 204, either the monaural coding mode or the stereo coding mode is set based on mode information received as input from mode setting section 202. To be more specific, upon setting the monaural decoding mode, first enhancement layer decoding section 204 decodes monaural encoded information received from de-multiplexing section 201 as input first enhancement layer encoded information, and acquires the core layer coding distortion of the M signal. First enhancement layer decoding section 204 adds the core layer coding distortion of the M signal and the core layer decoded M signal received as input from core layer decoding section 203, and outputs the addition result to second enhancement layer decoding section 205 as a first enhancement layer decoded M signal. The core layer decoded S signal received as input from core layer decoding section 203 is outputted as is to second enhancement layer decoding section 205 as a first enhancement layer decoded S signal.

In contrast, upon setting the stereo decoding mode, first enhancement layer decoding section 204 decodes stereo encoded information received from demultiplexing section 201 as input first enhancement layer encoded information, and acquires the core layer coding distortions of the M and S signals. First enhancement layer decoding section 204 adds the core layer coding distortion of the M signal and the core layer decoded M signal received as input from core layer decoding section 203, and outputs the addition result to second enhancement layer decoding section 205 as a first enhancement layer decoded M signal. Also, first enhancement layer decoding section 204 adds the core layer coding distortion of the S signal and the core layer decoded S signal received as input from core layer decoding section 203, and outputs the addition result to second enhancement layer decoding section 205 as a first enhancement layer decoded S signal. Also, first enhancement layer decoding section 204 will be described later in detail.

In second enhancement layer decoding section 205, either the monaural coding mode or the stereo coding mode is set based on mode information received as input from mode setting section 202. To be more specific, upon setting the monaural decoding mode, second enhancement layer decoding section 205 decodes monaural encoded information received from demultiplexing section 201 as input second enhancement layer encoded information, and acquires the first enhancement layer coding distortion related to the M signal. Second enhancement layer decoding section 205 adds the first enhancement layer coding distortion related to the M signal and the first enhancement layer decoded M signal received as input from first enhancement layer decoding section 204, and outputs the addition result to third enhancement layer decoding section 206 as a second enhancement layer decoded M signal. The first enhancement layer decoded S signal received as input from first enhancement layer decoding section 204 is outputted as is to third enhancement layer decoding section 206 as a second enhancement layer decoded S signal.

In contrast, upon setting the stereo decoding mode, second enhancement layer decoding section 205 decodes stereo encoded information received from demultiplexing section 201 as input second enhancement layer encoded information, and acquires the first enhancement layer coding distortions related to the M and S signals. Second enhancement layer decoding section 205 adds the first enhancement layer coding distortion related to the M signal and the first enhancement layer decoded M signal received as input from first enhancement layer decoding section 204, and outputs the addition result to third enhancement layer decoding section 206 as a second enhancement layer decoded M signal. Also, second enhancement layer decoding section 205 adds the first enhancement layer coding distortion related to the S signal and the first enhancement layer decoded S signal received as input from first enhancement layer decoding section 204, and outputs the addition result to third enhancement layer decoding section 206 as a second enhancement layer decoded S signal. Also, second enhancement layer decoding section 205 will be described later in detail.

In third enhancement layer decoding section 206, either the monaural coding mode or the stereo coding mode is set based on mode information received as input from mode setting section 202. To be more specific, upon setting the monaural decoding mode, third enhancement layer decoding section 206 decodes monaural encoded information received from demultiplexing section 201 as input third enhancement layer encoded information, and acquires the second enhancement layer coding distortion related to the M signal. Third enhancement layer decoding section 206 adds the second enhancement layer coding distortion related to the M signal and the second enhancement layer decoded M signal received as input from second enhancement layer decoding section 205, and outputs the addition result to sum and difference calculating section 207 as a third enhancement layer decoded M signal. The second enhancement layer decoded S signal received as input from second enhancement layer decoding section 205 is outputted as is to sum and difference calculating section 207 as a third enhancement layer decoded S signal.

In contrast, upon setting the stereo decoding mode, third enhancement layer decoding section 206 decodes stereo encoded information received from demultiplexing section 201 as input third enhancement layer encoded information, and acquires the second enhancement layer coding distortions related to the M and S signals. Third enhancement layer decoding section 206 adds the second enhancement layer coding distortion related to the M signal and the second enhancement layer decoded M signal received as input from second enhancement layer decoding section 205, and outputs the addition result to sum and difference calculating section 207 as a third enhancement layer decoded M signal. Also, third enhancement layer decoding section 206 adds the second enhancement layer coding distortion related to the S signal and the second enhancement layer decoded S signal received as input from second enhancement layer decoding section 205, and outputs the addition result to sum and difference calculating section 207 as a third enhancement layer decoded S signal. Also, third enhancement layer decoding section 206 will be described later in detail.

Sum and difference calculating section 207 calculates the decode L signal and the decoded R signal according to following equations 9 and 10, using the third enhancement layer decoded M signal and third enhancement layer decoded S signal received as input from third enhancement layer decoding section 206.

$$L_i'=(M_i'+S_i')/2 \quad \text{(Equation 9)}$$

$$R_i'=(M_i'-S_i')/2 \quad \text{(Equation 10)}$$

In equations 9 and 10, $M_i'$ represents the third enhancement layer decoded M signal, $S_i'$ represents the third enhancement layer decoded S signal, $L_i'$ represents the decoded L signal, and $R_i'$ represents the decoded R signal.

Figure 18:
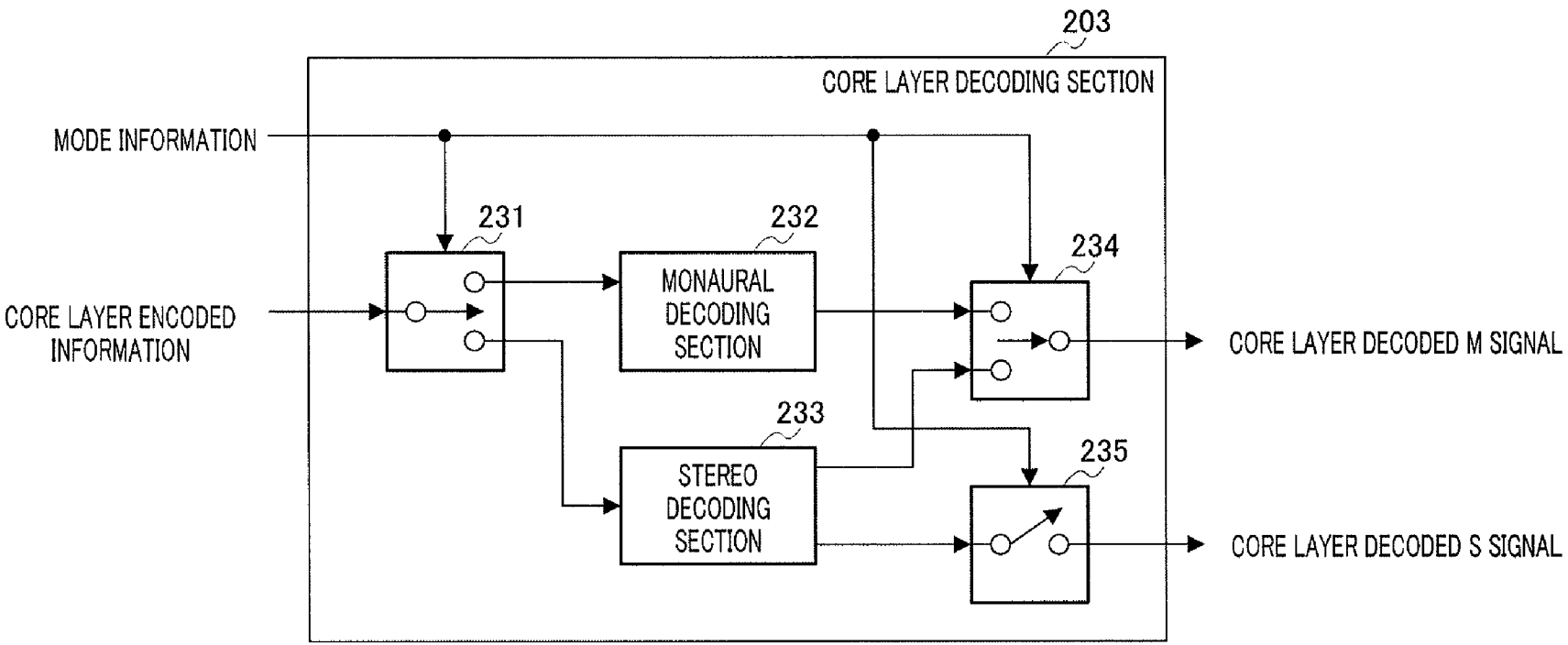
FIG. 18 is a block diagram showing the main components inside a core layer decoding section according to Embodiment 1 of the present invention.

FIG. 18 is a block diagram showing the main components inside core layer decoding section 203.

Core layer decoding section 203 shown in FIG. 18 is provided with switch 231, monaural decoding section 232, stereo decoding section 233, switch 234 and switch 235.

If the first bit value of mode information received as input from mode setting section 202 is "0," switch 231 outputs the monaural encoded information received from demultiplexing section 201 as input core layer encoded information, to monaural decoding section 232, and, if the first bit value of mode information received as input from mode setting section 202 is "1," outputs the stereo encoded information received from demultiplexing section 201 as input core layer encoded information, to stereo decoding section 233.

Monaural decoding section 232 performs monaural decoding using the monaural encoded information received as input from switch 231, and outputs the resulting core layer decoded M signal to switch 234. Also, the configuration and operations inside monaural decoding section 232 are the same as in monaural decoding section 303 shown in FIG. 11, and therefore their specific explanation will be omitted.

Stereo decoding section 233 performs stereo decoding using the stereo encoded information received as input from switch 231, outputs the resulting core layer decoded M signal and core layer decoded S signal to switch 234 and switch 235, respectively. Also, the configuration and operations inside stereo decoding section 233 are the same as in stereo decoding section 306 shown in FIG. 16, and therefore their specific explanation will be omitted.

If the first bit value of mode information received as input from mode setting section 202 is "0," switch 234 outputs the core layer decoded M signal received as input from monaural decoding section 232, to first enhancement layer decoding section 204. If the first bit value of mode information received as input from mode setting section 202 is "1," switch 234 outputs the core layer decoded M signal received as input from stereo decoding section 233, to first enhancement layer decoding section 204.

If the first bit value of mode information received as input from mode setting section 202 is "0," switch 235 is connected off and does not output a signal. Here, as equivalent processing, actually, a signal of all zero values (i.e. zero signal) is outputted to first enhancement layer decoding section 204 as a core layer decoded S signal. If the first bit value of mode information received as input from mode setting section 202 is "1," the core layer decoded S signal received as input from stereo decoding section 233 is outputted to first enhancement layer decoding section 204.

Figure 19:
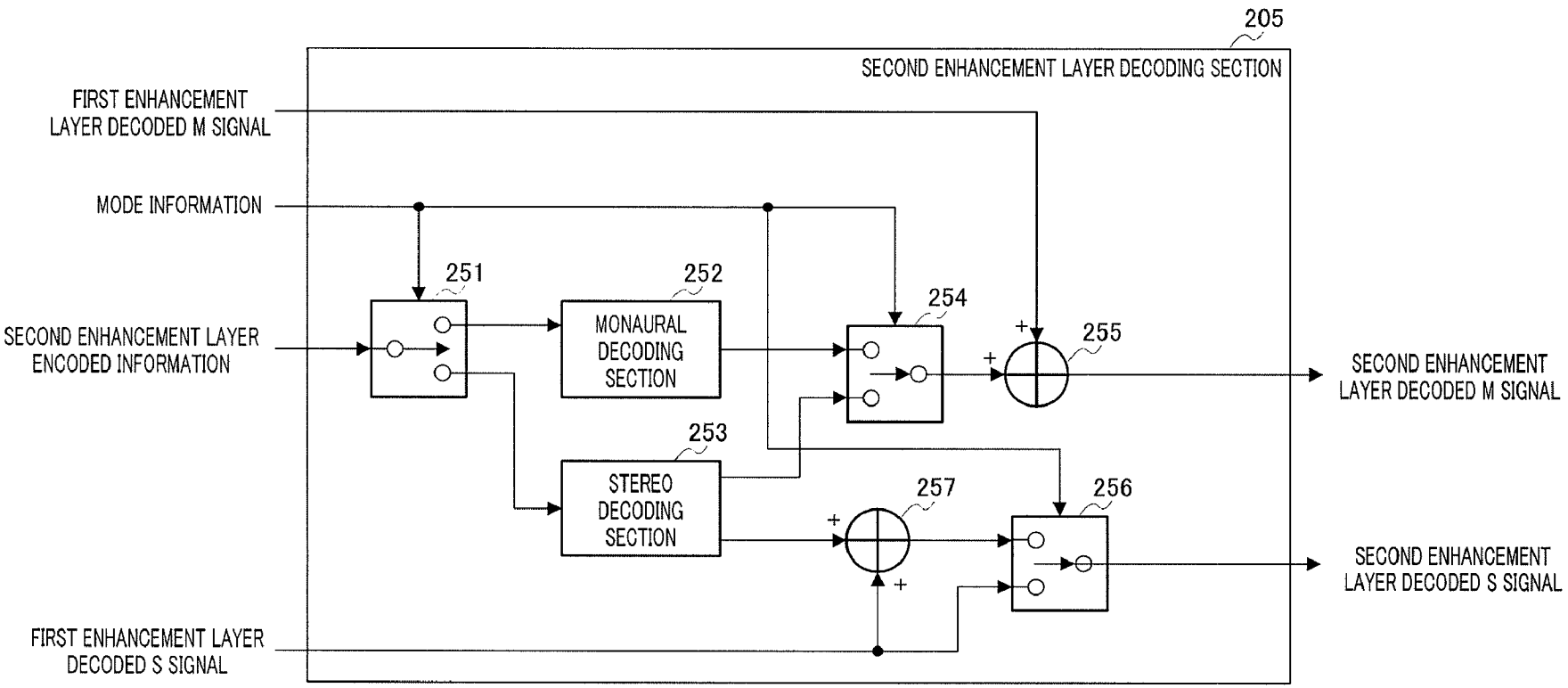
FIG. 19 is a block diagram showing the main components inside a second enhancement layer decoding section according to Embodiment 1 of the present invention.

FIG. 19 is a block diagram showing the main components inside second enhancement layer decoding section 205. Here, first enhancement layer decoding section 204, second enhancement layer decoding section 205 and third enhancement layer decoding section 206 shown in FIG. 17 have the same internal configuration and operations, but are different in input signals and output signals. Therefore, an example case will be explained using only second enhancement layer decoding section 205.

In FIG. 19, second enhancement layer decoding section 205 is provided with switch 251, monaural decoding section 252, stereo decoding section 253, switch 254, adder 255, switch 256 and adder 257.

If the third bit value of mode information received as input from mode setting section 202 is "0," switch 251 outputs monaural encoded information received from demultiplexing section 201 as input second enhancement layer encoded information, to monaural decoding section 252.

Also, if the third bit value of mode information received as input from mode setting section 202 is "1," switch 251 outputs stereo encoded information received from demultiplexing section 201 as input second enhancement layer encoded information, to stereo decoding section 253.

Monaural decoding section 252 performs monaural decoding using the monaural encoded information received as input from switch 251, and outputs the resulting first enhancement layer coding distortion related to the M signal to switch 254. Also, the configuration and operations inside monaural decoding section 252 shown in FIG. 11 are the same as in monaural decoding section 303, and therefore their specific explanation will be omitted.

Stereo decoding section 253 performs stereo decoding using stereo encoded information received as input from switch 251, and outputs the resulting first enhancement layer coding distortion related to the M signal and first enhancement layer coding distortion related to the S signal to switch 254 and switch 257, respectively. Also, the configuration and operations inside stereo decoding section 253 are the same as in stereo decoding section 306 shown in FIG. 16, and therefore their specific explanation will be omitted.

If the third bit value of mode information received as input from mode setting section 202 is "0," switch 254 outputs the first enhancement layer coding distortion related to the M signal received as input from monaural decoding section 252, to adder 255. Also, if the third bit value of mode information received as input from mode setting section 202 is "1," switch 254 outputs the first enhancement layer coding distortion related to the M signal received as input from stereo decoding section 253, to adder 255.

Adder 255 adds the first enhancement layer coding distortion related to the M signal received as input from switch 254 and the first enhancement layer decoded M signal received as input from first enhancement layer decoding section 204, and outputs the addition result to third enhancement layer decoding section 206 as a second enhancement layer decoded M signal.

Adder 257 adds the first enhancement layer coding distortion related to the S signal received as input from stereo decoding section 253 and the first enhancement layer decoded S signal received as input from first enhancement layer decoding section 204, and outputs the result to switch 256.

If the second bit value of mode information received as input from mode setting section 202 is "0," switch 256 outputs the first enhancement layer decoded S signal received as input from first enhancement layer decoding section 204, as is to third enhancement layer decoding section 206. Also, if the second bit value of mode information received as input from mode setting section 202 is "1," switch 256 outputs the addition result received as input from adder 257, to third enhancement layer decoding section 206 as a second enhancement layer decoded S signal.

Thus, according to the present embodiment, scalable coding is performed for a monaural signal (i.e. M signal) and a side signal (i.e. S signal) calculated from the L signal and the R signal of a stereo signal, so that it is possible to perform scalable coding using the correlation between the L signal and the R signal. Further, according to the present embodiment, the coding mode in each layer in scalable coding is set based on mode information, so that it is possible to set a layer for performing monaural coding and a layer for performing stereo coding, and improve the degree of freedom in controlling the accuracy of coding.

Also, according to the present embodiment, the M signal spectrum and the S signal spectrum are integrated and encoded such that spectrums of the same frequency are adjacent to each other, so that it is possible to perform automatic bit allocation without special decision or case classification in stereo coding, and perform efficient coding according to the significance of information of the L signal and R signal.

Embodiment 2

Figure 20:
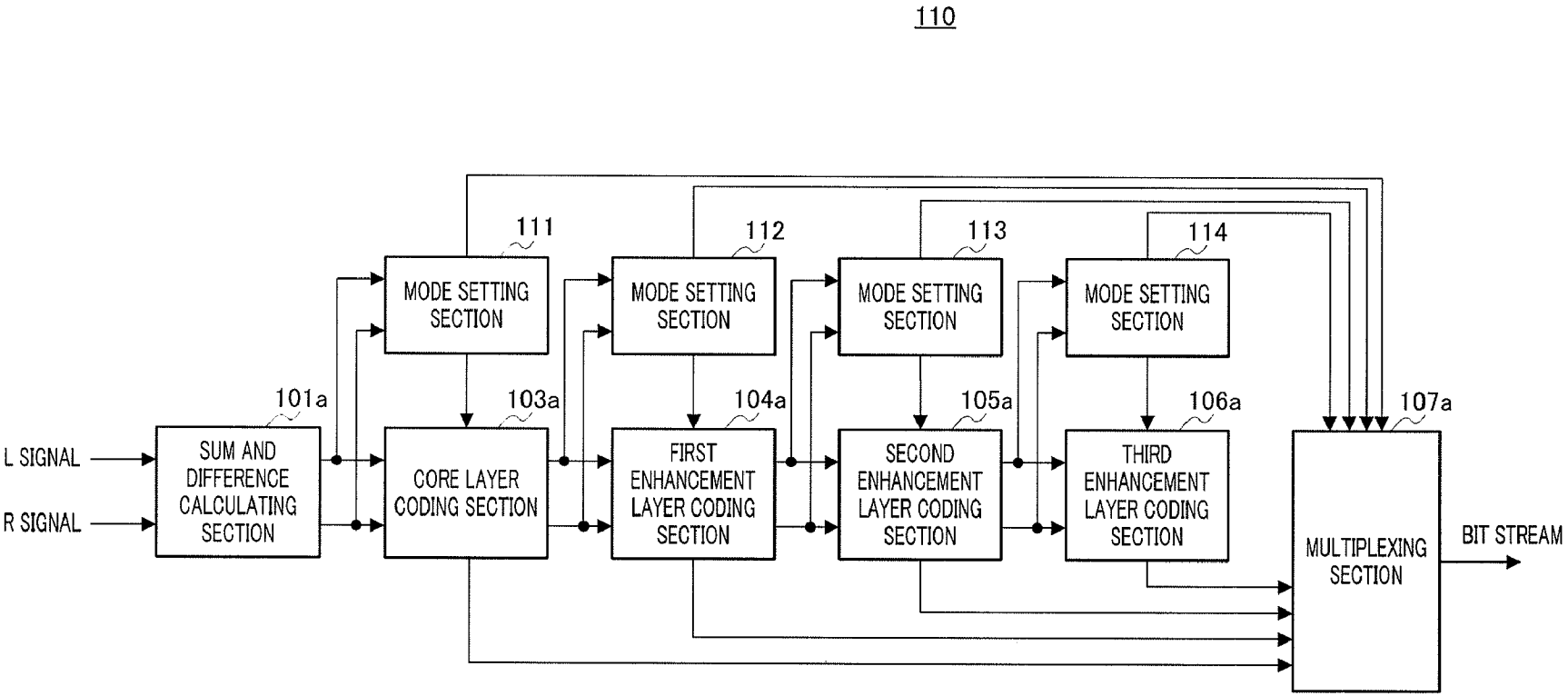
FIG. 20 is a block diagram showing the main components of a stereo signal coding apparatus according to Embodiment 2 of the present invention.

FIG. 20 is a block diagram showing the main components of stereo signal coding apparatus 110 according to Embodiment 2 of the present invention. Stereo signal coding apparatus 110 shown in FIG. 20 has basically the same configuration and performs basically the same operations as stereo signal coding apparatus 100 shown in FIG. 1. Consequently, as for sections that perform the same operations between FIG. 1 and FIG. 20, "a" is assigned to the reference numerals of the sections in FIG. 20. For example, a section in FIG. 20 corresponding to sum and difference calculating section 101 in FIG. 1 is expressed as sum and difference calculating section 101*a*. Also, stereo signal coding apparatus 110 in FIG. 20 differs from stereo signal coding apparatus 100 in FIG. 1 in further including mode setting sections 112 to 114. Also, mode setting section 111 of stereo signal coding apparatus 110 in FIG. 20 differs from mode setting section 102 of stereo signal coding apparatus 100 in FIG. 1 in input signals, and is therefore assigned a different reference numeral. Here, mode setting sections 111 to 114 shown in FIG. 20 have the same internal configuration and operations, but are different in input signals and output signals. Therefore, an example case will be explained using only mode setting section 111.

Mode setting section 111 calculates the power of the M signal and S signal received as input from sum and difference calculating section 101*a*, and, based on the calculated power and predetermined conditional equations, sets a monaural coding mode for encoding only M signal information or a stereo coding mode for encoding both M signal information and S signal information. For example, the stereo coding mode is set if the power of the S signal is higher than the power of the M signal, or the monaural coding mode is set if the power of the S signal is lower than the power of the M signal. Also, if the power of the M signal and the power of the S signal are both low, the monaural coding mode is set. This takes into account that, when coders are designed, a stereo signal coder that handles two types of signals provides a higher bit rate than a monaural signal coder that handles a single type of signal. Also, information about the set mode is outputted to core layer coding section 103*a* and multiplexing section 107*a*.

The power calculation in mode setting section 111 is performed according to following equations 11 and 12.

(Equation 11)

$$PowM = \sum_i M_i^2 \quad [7]$$

(Equation 12)

$$PowS = \sum_i S_i^2$$

In equations 11 and 12, i represents the sample number, PowM represents the power of the M signal, and M, represents the M signal. Also, PowS represents the power of the S signal, and $S_i$ represents the S signal.

The predetermined conditional equation in mode setting section 111 is shown in following equation 13.

[8]

if Pow$S$+Pow$M$<α then $m$=0 else if Pow$S$<Pow$M$·β then $m$=0 else $m$=1 (Equation 13)

In equation 13, α represents the total power evaluation constant, and may adopt the upper limit value of the power of a signal that is not perceived. Also, β represents the S signal power evaluation constant. The method of calculating S signal power evaluation constant β will be described later. Also, m represents the mode. Here, total power evaluation constant α and S signal power evaluation constant β are stored in a ROM, for example.

As for S signal power evaluation constant β, if the signal of the smaller coding distortion is selected from the L signal and the R signal, the method of statistically calculating and storing respective β's in mode setting sections 111 to 114 is possible. A specific method of calculating S signal power evaluation constant β will be explained below.

Here, the method of calculating S signal power evaluation constant β in mode setting section 111 will be explained. First, a large number of stereo speech data is received as input in mode setting section 111 for learning, and the ratio between the power of the M signal and the power of the S signal is calculated according to following equation 14.

(Equation 14)

$$R_j = PowS_j / PowM_j \quad [9]$$

$$PowM_j = \sum_i M_i^{j2}$$

$$PowS_j = \sum_i S_i^{j2}$$

In equation 14, i represents the sample number of each signal, and j represents the number of learning stereo speech data. Also, M, represents the M signal, and $S_i$ represents the S signal. Also, $PowM_j$ represents the power of the M signal of the J-th learning stereo speech data, and $PowS_j$ represents the power of the S signal of the J-th learning stereo speech data.

Next, opposite processing to downmixing is performed for a decoded M signal and decoded S signal acquired by coding and decoding in two modes in core layer coding section 103*a*, to find a decoded L signal and decoded R signal. Sums of the S/N ratios of the resulting decoded L signal and decoded R signal (i.e. the S/N ratios in a case where the coding distortions of the L signal and R signal received as input in stereo signal coding apparatus 110 are regarded as noise), that is, $E^0_j$ and $E^1_j$ are calculated.

Next, by changing the value of β little by little between 0 and 1.0, total S/N ratio $E_\beta$ shown in following equation 15 is calculated.

(Equation 15)

$$E_\beta = \sum_j \{\text{if } Rj < \beta \text{ then } E_j^0 \text{ else } E_j^1\} \quad [10]$$

The value of β to maximize above $E_\beta$ is calculated. This value is stored in mode setting section 111 and used as S signal power evaluation constant β. Similar to mode setting section 111, mode setting sections 112 to 114 each calculate and store S signal power evaluation constant β.

Also, the stereo signal decoding apparatus according to Embodiment 2 of the present invention has the same configuration as in FIG. 17 of Embodiment 1, and therefore explanation will be omitted.

Thus, according to the present embodiment, as coding processing in each layer proceeds, the coding mode in each layer in scalable coding is set based on local features of speech, so that it is possible to automatically set a layer for performing monaural coding and a layer for performing stereo coding, and provide decoded signals of high quality. Also, if the bit rate varies between modes, the transmission rate is automatically controlled, so that it is possible to save the number of information bits.

Embodiments of the present invention have been described above.

Also, although cases have been described above with embodiments where stereo signals are mainly used as speech signals, it is needless to say that stereo signals can be used as audio signals.

Also, although example cases have been described above with embodiments where integrating section 353 integrates the M signal spectrum and S signal spectrum such that the spectrums of the same frequency are adjacent to each other, the present invention is not limited to this, and it is equally possible to integrate those spectrums in integrating section 353 such that the S signal spectrum is simply and adjacently arranged before or after the M signal spectrum.

Also, although cases have been described above with embodiments where two types of stereo signals are represented using the names "left channel signal" and "right channel signal," it is equally possible to use more general names like "first channel signal" and "second channel signal."Also, the association between the bit values "0" and "1" and the coding modes "monaural coding mode" and "stereo coding mode," is not limited.

Also, although example cases have been described above with embodiments where the present invention applies to the specification in which the sampling rate is 16 kHz and the frame length is 20 ms, the present invention is not limited to this, and it is equally possible to apply the present invention to other specifications in which the sampling rate is 8 kHz, 24 kHz, 32 kHz, 44.1 kHz, 48 kHz, and so on, and the frame length is 10 ms, 30 ms, 40 ms, and so on. The present invention does not depend on the sampling rate or frame length.

Also, although cases have been described above with embodiments where a four-layer configuration is employed in scalable coding, the present invention is not limited to this, and it is equally possible to use other numbers of layers than four. The present invention does not depend on the number of layers.

Also, although example cases have been described above with embodiments where pulse coding is used to encode an excitation signal spectrum, the present invention is not limited to this, and, to encode an excitation signal spectrum, it is equally possible to use VQ, predictive VQ, split VQ, multistage VQ, band extension techniques, inter-channel prediction coding, and so on. The present invention does not depend on spectrum coding schemes.

Also, although example cases have been described above with embodiments where stereo signals are encoded to transmit encoded information, the present invention is not limited to this, and it is equally possible to store encoded information in a storage medium. For example, although encoded information of audio signals is often stored in memory or disk and used, the present invention is equally effective in this case. The present invention does not depend on whether encoded information is transmitted or stored.

Also, although example cases have been described above with embodiments where a stereo signal is formed with two channels, the present invention is not limited to this, and it is equally possible to form a stereo signal with multiple channels like 5.1 channels.

Also, although cases have been described above with embodiments where coding is performed using only the size of the spectrums of the M signal and S signal as a measure of distance, the present invention is not limited to this, and it is equally possible to perform coding using the phase difference or energy ratio between the M signal and the S signal, as a measure of distance. The present invention does not depend on the measure of distance to use in spectrum coding.

Also, although cases have been described above with embodiments where the stereo signal decoding apparatus receives and processes bit streams transmitted from the stereo signal coding apparatus, the present invention is not limited to this, and the stereo signal decoding apparatus can receive and process bit streams as long as these bit streams are transmitted from a coding apparatus that can generate bit streams that can be processed in that decoding apparatus.

Also, the stereo signal coding apparatus and stereo signal decoding apparatus according to the present invention can be mounted on a communication terminal apparatus and base station apparatus in a mobile communication system, so that it is possible to provide a communication terminal apparatus, base station apparatus and mobile communication system having the same operational effects as above.

Although example cases have been described with the above embodiments where the present invention is implemented with hardware, the present invention can be implemented with software. For example, by describing the algorithm according to the present invention in a programming language, storing this program in a memory and making the information processing section execute this program, it is possible to implement the same function as in the stereo signal coding apparatus according to the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2008-72497, filed on Mar. 19, 2008, and Japanese Patent Application No. 2008-274536, filed on Oct. 24, 2008, including the specifications, drawings and abstracts, are incorporated herein by reference in their entireties.

INDUSTRIAL APPLICABILITY

The present invention is suitable for use in, for example, a coding apparatus that encodes speech signals and audio signals, and in a decoding apparatus that decodes encoded signals.

The invention claimed is:

1. A stereo signal coding apparatus, comprising:

a sum and difference calculator that generates a monaural signal related to a sum of a first channel signal and second channel signal forming a stereo signal, and generates a side signal related to a difference between the first channel signal and the second channel signal;

a mode information generator that generates mode information per layer indicating a coding mode of one of monaural coding and stereo coding; and first to N-th layer coders that perform monaural coding in an i-th layer (i=1, 2, . . . , N, where N is an integer equal to or greater than 2) using information related to the monaural signal or performs stereo coding in the i-th layer using both the information related to the monaural signal and information related to the side signal, based on the mode information, and provide i-th layer encoded information, wherein the mode information generator generates the mode information of N bits indicating the coding mode, using each of the bits, the i-th layer coder performs monaural coding in the i-th layer or performs stereo coding in the i-th layer, based on a value of an i-th bit of the mode information, and the first layer coder comprises:

a first layer monaural coder that, when a value of a first bit of the mode information indicates monaural coding, performs monaural coding in a first layer using the monaural signal and outputs a coding distortion related to the monaural signal in the first layer and the side signal to the second layer coder; and a first layer stereo coder that, when the value of the first bit of the mode information indicates stereo coding, performs stereo coding in the first layer using both the monaural signal and the side signal, and outputs a coding distortion related to the monaural signal in the first layer and a coding distortion related to the side signal in the first layer to the second layer coder.

2. The stereo signal coding apparatus according to claim 1, wherein:

the mode information generator generates the mode information of N bits indicating the coding mode, using each of the bits; and the i-th layer coder performs monaural coding in the i-th layer or performs stereo coding in the i-th layer, based on a value of an i-th bit of the mode information.

3. The stereo signal coding apparatus according to claim 1, wherein the n-th (n=2, 3 . . . N−1) layer coder comprises:

an n-th layer monaural coder that, when a value of an n-th bit of the mode information indicates monaural coding, performs monaural coding in an n-th layer using the information related to the monaural signal, and outputs a coding distortion related to the monaural signal in the n-th layer and the information related to the side signal received as input from the (n−1)-th layer, to an (n+l)-th layer coder; and an n-th layer stereo coder that, when the value of the n-th bit of the mode information indicates stereo coding, performs stereo coding in the n-th layer using both the information related to the monaural signal and the information related to the side signal, and outputs a coding distortion related to the monaural signal in the n-th layer and a coding distortion related to the side signal in the n-th layer to the (n+l)-th layer coder.

4. The stereo signal coding apparatus according to claim 3, wherein the N-th layer coder comprises:

an N-th layer monaural coder that, when a value of an N-th bit of the mode information indicates monaural coding, performs monaural coding in an N-th layer using the information related to the monaural signal; and an N-th layer stereo coder, when the value of the N-th bit of the mode information indicates stereo coding, performs stereo coding in the N-th layer using both the information related to the monaural signal and the information related to the side signal.

5. The stereo signal coding apparatus according to claim 4, wherein the i-th layer stereo coder comprises:

a first converter that converts the information related to the monaural signal into a frequency domain and provides a first spectrum;

a second converter that converts the information related to the side signal into a frequency domain and provides a second spectrum;

an integrator that integrates the first spectrum and the second spectrum to provide an integrated spectrum; and a spectrum coder that performs spectrum coding of the integrated spectrum.

6. The stereo signal coding apparatus according to claim 5, wherein the integrator integrates the first spectrum and the second spectrum such that spectrums of same frequency are adjacent to each other.

7. The stereo signal coding apparatus according to claim 5, wherein the integrator integrates the first spectrum and the second spectrum such that the first spectrum is adjacent before or after the second spectrum.

8. The stereo signal coding apparatus according to claim 1, wherein the mode information generator generates the mode information to apply to an (i+l)-th layer, using the monaural signal and the side signal received as input in the i-th layer coder.

9. The stereo signal coding apparatus according to claim 8, wherein the mode information generator calculates powers of the monaural signal and the side signal received as input in the i-th layer coder, and generates mode information based on a relative relationship between the calculated powers.

10. A stereo signal decoding apparatus, comprising:

a receiver that receives mode information and first to N-th layer encoded information acquired by coding processing in first to N-th layers, the mode information indicating which of monaural coding and stereo coding is performed in coding processing in an i-th layer (i=1, 2, . . . , N, where N is an integer equal to or greater than 2) of a stereo signal coding apparatus that performs coding using a first channel signal and second channel signal forming a stereo signal;

first to N-th layer decoders that perform monaural decoding or stereo decoding using the i-th layer encoded information, based on the mode information, and provide a decoding result of a monaural signal in the i-th layer and a decoding result of a side signal in the i-th layer, the monaural signal being related to a sum of the first channel signal and the second channel signal, and the side signal being related to a difference between the first channel signal and the second channel signal; and a sum and difference calculator that calculates a first channel decoded signal and second channel decoded signal using a decoding result of the monaural signal in the N-th layer and a decoding result of the side signal in the N-th layer, wherein the first layer decoder comprises:

a first layer monaural decoder that, when a value of a first bit of the mode information indicates monaural decoding, performs monaural decoding in a first layer using the monaural signal and outputs a decoding result related to the monaural signal in the first layer and the side signal to the second layer decoder; and a first layer stereo decoder that, when the value of the first bit of the mode information indicates stereo decoding, performs stereo decoding in the first layer using both the monaural signal and the side signal, and outputs a decoding result related to the monaural signal in the first layer and a decoding distortion related to the side signal in the first layer to the second layer decoder.

11. A stereo signal coding method, comprising:

generating a monaural signal related to a sum of a first channel signal and second channel signal forming a stereo signal, and generating a side signal related to a difference between the first channel signal and the second channel signal forming the stereo signal;

generating mode information per layer in a plurality of layers, the mode information indicating a coding mode of one of monaural coding and stereo coding; and performing monaural coding in an i-th layer (i=1, 2, . . . , N, where N is an integer equal to or greater than 2) using information related to the monaural signal or performs stereo coding in the i-th layer using both the information related to the monaural signal and information related to the side signal, based on the mode information, and providing i-th layer encoded information, wherein a first layer coding comprises:

a first layer monaural coding that, when a value of a first bit of the mode information indicates monaural coding, performs monaural coding in a first layer using the monaural signal and outputs a coding distortion related to the monaural signal in the first layer and the side signal to the second layer coding; and a first layer stereo coding that, when the value of the first bit of the mode information indicates stereo coding, performs stereo coding in the first layer using both the monaural signal and the side signal, and outputs a coding distortion related to the monaural signal in the first layer and a coding distortion related to the side signal in the first layer to the second layer coding.

12. A stereo signal decoding method, comprising:

receiving mode information and first to N-th layer encoded information acquired by coding processing in first to N-th layers, the mode information indicating which of monaural coding and stereo coding is performed in coding processing in an i-th layer (i=1, 2, . . . , N, where N is an integer equal to or greater than 2) of a stereo signal coding apparatus that performs coding using a first channel signal and second channel signal forming a stereo signal;

performing monaural decoding or stereo decoding using the i-th layer encoded information, based on the mode information, and providing a decoding result of a monaural signal in the i-th layer and a decoding result of a side signal in the i-th layer, the monaural signal being related to a sum of the first channel signal and the second channel signal, and the side signal being related to a difference between the first channel signal and the second channel signal; and calculating a first channel decoded signal and a second channel decoded signal using a decoding result of the monaural signal in the N-th layer and a decoding result of the side signal in the N-th layer;

wherein a first layer decoder comprises:

a first layer monaural decoder that, when a value of a first bit of the mode information indicates monaural decoding, performs monaural decoding in a first layer using the monaural signal and outputs a decoding result related to the monaural signal in the first layer and the side signal to the second layer decoder; and a first layer stereo decoder that, when the value of the first bit of the mode information indicates stereo decoding, performs stereo decoding in the first layer using both the monaural signal and the side signal, and outputs a decoding result related to the monaural signal in the first layer and a decoding result related to the side signal in the first layer to the second layer decoder.

* * * * *

UNITED STATES PATENT AND TRADEMARK OFFICE

CERTIFICATE OF CORRECTION

PATENT NO. : 8,386,267 B2
APPLICATION NO. : 12/919100
DATED : February 26, 2013
INVENTOR(S) : Toshiyuki Morii It is certified that error appears in the above-identified patent and that said Letters Patent is hereby corrected as shown below:

In the Claims

At column 29, line 66 (claim 4, line 7) of the printed patent, the term --that-- should be inserted after coder and before the “,”.

Signed and Sealed this
Twenty-fifth Day of June, 2013

Teresa Stanek Rea
*Acting Director of the United States Patent and Trademark Office*